US010931041B2

(12) United States Patent
Thomas et al.

(10) Patent No.: US 10,931,041 B2
(45) Date of Patent: Feb. 23, 2021

(54) CABLE CONNECTOR HAVING A SLIDER FOR COMPRESSION

(71) Applicant: PPC Broadband, Inc., East Syracuse, NY (US)

(72) Inventors: Charles E. Thomas, Athens, PA (US); Timothy Tremba, Cayuta, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/149,258

(22) Filed: Oct. 2, 2018

(65) Prior Publication Data

US 2019/0036241 A1 Jan. 31, 2019

Related U.S. Application Data

(63) Continuation of application No. 15/351,436, filed on Nov. 14, 2016, now Pat. No. 10,090,610, which is a (Continued)

(51) Int. Cl.
*H01R 9/05* (2006.01)
*H01R 13/627* (2006.01)
(Continued)

(52) U.S. Cl.
CPC ..... *H01R 9/0521* (2013.01); *H01R 13/6277* (2013.01); *H01R 24/28* (2013.01); *H01R 24/38* (2013.01); *H01R 2103/00* (2013.01)

(58) Field of Classification Search
CPC ... H01R 9/0518; H01R 13/59; H01R 13/5825
(Continued)

(56) References Cited

U.S. PATENT DOCUMENTS 1,667,485 A 4/1928 MacDonald
2,258,737 A 10/1941 Browne
(Continued)

FOREIGN PATENT DOCUMENTS

DE 102289 C 7/1897
DE 1117687 B 11/1961
(Continued)

OTHER PUBLICATIONS

Mar. 28, 2016 Office Action Issued in U.S. Appl. No. 14/457,498.
(Continued)

*Primary Examiner* — Hae Moon Hyeon
(74) *Attorney, Agent, or Firm* — MH2 Technology Law Group LLP

(57) ABSTRACT

A coaxial cable connector is attachable to a coaxial cable. The connector may include a connector body, a coupler, and a slider. The connector body may include a forward end and a rearward end. The rearward end may be configured to receive a portion of a coaxial cable, and the connector body may be configured to receive at least a portion of the post. The coupler may be configured to be rotatably coupled to the forward end of the connector body, and the slider may be configured to receive the connector body. The slider may be configured to move relative to the connector body in a rearward direction from a first position to a second position and to compress a portion of the coaxial cable between the connector body and a post as a result of the slider being moved from the first position to the second position.

20 Claims, 18 Drawing Sheets

Related U.S. Application Data continuation of application No. 14/457,498, filed on Aug. 12, 2014, now Pat. No. 9,496,631, which is a continuation of application No. 14/046,718, filed on Oct. 4, 2013, now Pat. No. 8,840,429, which is a continuation of application No. 12/896,156, filed on Oct. 1, 2010, now Pat. No. 8,556,656.

(51) Int. Cl.
*H01R 24/28* (2011.01)
*H01R 24/38* (2011.01)
*H01R 103/00* (2006.01)

(58) Field of Classification Search
USPC ..... 439/584, 585, 460
See application file for complete search history.

(56) References Cited

U.S. PATENT DOCUMENTS 2,544,654 A 3/1951 Brown
2,549,647 A 4/1951 Turene
3,184,706 A 5/1965 Atkins
3,275,913 A 9/1966 Blanchard
3,292,136 A 12/1966 Somerset
3,350,677 A 10/1967 Daum
3,355,698 A 11/1967 Keller
3,373,243 A 3/1968 Janowiak
3,406,373 A 10/1968 Forney, Jr.
3,448,430 A 6/1969 Kelly
3,475,545 A 10/1969 Stark
3,498,647 A 3/1970 Schroder
3,517,373 A 6/1970 Jamon
3,533,051 A 10/1970 Ziegler, Jr.
3,537,065 A 10/1970 Winston
3,544,705 A 12/1970 Winston
3,564,487 A 2/1971 Upstone
3,629,792 A 12/1971 Dorrell
3,633,150 A 1/1972 Swartz
3,668,612 A 6/1972 Nepovim
3,671,922 A 6/1972 Zerlin et al.
3,694,792 A 9/1972 Wallo
3,710,005 A 1/1973 French
3,778,535 A 12/1973 Forney, Jr.
3,781,762 A 12/1973 Quackenbush
3,836,700 A 9/1974 Niemeyer
3,845,453 A 10/1974 Hemmer
3,846,738 A 11/1974 Nepovim
3,854,003 A 12/1974 Duret
3,879,102 A 4/1975 Horak
3,907,399 A 9/1975 Spinner
3,910,673 A 10/1975 Stokes
3,915,539 A 10/1975 Collins
3,936,132 A 2/1976 Hutter
3,963,320 A 6/1976 Spinner
3,976,352 A 8/1976 Spinner
3,980,805 A 9/1976 Lipari
3,985,418 A 10/1976 Spinner
4,046,451 A 9/1977 Juds et al.
4,053,200 A 10/1977 Pugner
4,059,330 A 11/1977 Shirey
4,093,335 A 6/1978 Schwartz et al.
4,126,372 A 11/1978 Hashimoto et al.
4,131,332 A 12/1978 Hogendobler et al.
4,150,250 A 4/1979 Lundeberg
4,156,554 A 5/1979 Aujla
4,165,554 A 8/1979 Faget
4,168,921 A 9/1979 Blanchard
4,225,162 A 9/1980 Dola
4,227,765 A 10/1980 Neumann et al.
4,250,348 A 2/1981 Kitagawa
4,280,749 A 7/1981 Hemmer
4,339,166 A 7/1982 Dayton
4,346,958 A 8/1982 Blanchard
4,354,721 A 10/1982 Luzzi
4,373,767 A 2/1983 Cairns
4,400,050 A 8/1983 Hayward
4,408,821 A 10/1983 Forney, Jr.
4,408,822 A 10/1983 Nikitas
4,421,377 A 12/1983 Spinner
4,444,453 A 4/1984 Kirby et al.
4,456,323 A 6/1984 Pitcher
4,484,792 A 11/1984 Tengler et al.
4,515,427 A 5/1985 Smit
4,533,191 A 8/1985 Blackwood
4,540,231 A 9/1985 Forney, Jr.
4,545,637 A 10/1985 Bosshard et al.
4,575,274 A 3/1986 Hayward
4,583,811 A 4/1986 McMills
4,593,964 A 6/1986 Forney, Jr. et al.
4,596,434 A 6/1986 Saba et al.
4,596,435 A 6/1986 Bickford
4,598,961 A 7/1986 Cohen
4,600,263 A 7/1986 DeChamp et al.
4,614,390 A 9/1986 Baker
4,632,487 A 12/1986 Wargula
4,640,572 A 2/1987 Conlon
4,645,281 A 2/1987 Burger
4,650,228 A 3/1987 McMills et al.
4,655,159 A 4/1987 McMills
4,660,921 A 4/1987 Hauver
4,668,043 A 5/1987 Saba et al.
4,674,818 A 6/1987 McMills et al.
4,676,577 A 6/1987 Szegda
4,682,832 A 7/1987 Punako et al.
4,688,876 A 8/1987 Morelli
4,688,878 A 8/1987 Cohen et al.
4,691,976 A 9/1987 Cowen
4,703,987 A 11/1987 Gallusser et al.
4,717,355 A 1/1988 Mattis
4,738,009 A 4/1988 Down et al.
4,746,305 A 5/1988 Nomura
4,747,786 A 5/1988 Hayashi et al.
4,755,152 A 7/1988 Elliot et al.
4,761,146 A 8/1988 Sohoel
4,772,222 A 9/1988 Laudig et al.
4,789,355 A 12/1988 Lee
4,806,116 A 2/1989 Ackerman
4,813,886 A 3/1989 Roos et al.
4,834,675 A 5/1989 Samchisen
4,854,893 A 8/1989 Morris
4,857,014 A 8/1989 Alf et al.
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,923,412 A 5/1990 Morris
4,925,403 A 5/1990 Zorzy
4,927,385 A 5/1990 Cheng
4,929,188 A 5/1990 Lionetto et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
5,002,503 A 3/1991 Campbell et al.
5,007,861 A 4/1991 Stirling
5,021,010 A 6/1991 Wright
5,024,606 A 6/1991 Ming-Hwa
5,037,328 A 8/1991 Karlovich
5,062,804 A 11/1991 Jamet et al.
5,066,248 A 11/1991 Gaver, Jr. et al.
5,073,129 A 12/1991 Szegda
5,083,943 A 1/1992 Tarrant
5,120,260 A 6/1992 Jackson
5,127,853 A 7/1992 McMills et al.
5,131,862 A 7/1992 Gershfeld
5,141,451 A 8/1992 Down
5,161,993 A 11/1992 Leibfried, Jr.
5,195,906 A 3/1993 Szegda
5,205,761 A 4/1993 Nilsson

(56) References Cited

U.S. PATENT DOCUMENTS 5,207,602 A 5/1993 McMills et al.
5,217,391 A 6/1993 Fisher, Jr.
5,217,393 A 6/1993 Del Negro et al.
5,269,701 A 12/1993 Leibfried, Jr.
5,283,853 A 2/1994 Szegda
5,284,449 A 2/1994 Vaccaro
5,295,864 A 3/1994 Birch et al.
5,316,494 A 5/1994 Flanagan et al.
5,338,225 A 8/1994 Jacobsen et al.
5,342,218 A 8/1994 McMills et al.
5,354,217 A 10/1994 Gabel et al.
5,371,819 A 12/1994 Szegda
5,371,821 A 12/1994 Szegda
5,371,827 A 12/1994 Szegda
5,393,244 A 2/1995 Szegda
5,431,583 A 7/1995 Szegda
5,435,745 A 7/1995 Booth
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,494,454 A 2/1996 Johnsen
5,501,616 A 3/1996 Holliday
5,525,076 A 6/1996 Down
5,542,861 A 8/1996 Anhalt et al.
5,548,088 A 8/1996 Gray et al.
5,571,028 A 11/1996 Szegda
5,586,910 A 12/1996 Del Negro et al.
5,598,132 A 1/1997 Stabile
5,607,325 A 3/1997 Toma
5,620,339 A 4/1997 Gray et al.
5,632,651 A 5/1997 Szegda
5,651,699 A 7/1997 Holliday
5,667,405 A 9/1997 Holliday
5,863,220 A 1/1999 Holliday
D407,370 S 3/1999 Wang
5,879,191 A 3/1999 Burris
5,967,852 A 10/1999 Follingstad et al.
5,975,951 A 11/1999 Burris et al.
5,997,350 A 12/1999 Burris et al.
6,032,358 A 3/2000 Wild
6,089,912 A 7/2000 Tallis et al.
6,089,913 A 7/2000 Holliday
6,146,197 A 11/2000 Holliday et al.
6,153,830 A 11/2000 Montena
6,210,222 B1 4/2001 Langham et al.
6,217,383 B1 4/2001 Holland et al.
6,241,553 B1 6/2001 Hsia
6,261,126 B1 7/2001 Stirling
6,331,123 B1 12/2001 Rodrigues
D458,904 S 6/2002 Montena
D460,739 S 7/2002 Fox
D460,740 S 7/2002 Montena
D460,946 S 7/2002 Montena
D460,947 S 7/2002 Montena
D460,948 S 7/2002 Montena
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
D462,327 S 9/2002 Montena
D468,696 S 1/2003 Montena
6,530,807 B2 3/2003 Rodrigues et al.
6,558,194 B2 5/2003 Montena
D475,976 S 6/2003 Montena
D475,977 S 6/2003 Montena
6,676,446 B2 1/2004 Montena
6,767,248 B1 7/2004 Hung
6,780,052 B2 8/2004 Montena et al.
6,783,394 B1 8/2004 Holliday
6,805,584 B1 10/2004 Chen
6,817,896 B2 11/2004 Derenthal
6,830,479 B2 * 12/2004 Holliday ..... H01R 9/0518 439/578
6,848,940 B2 2/2005 Montena
6,884,113 B1 4/2005 Montena
6,887,102 B1 5/2005 Burris et al.
7,029,326 B2 4/2006 Montena
7,059,900 B2 6/2006 Holliday
7,063,565 B2 6/2006 Ward
7,086,897 B2 8/2006 Montena
7,114,990 B2 10/2006 Bence et al.
7,118,416 B2 10/2006 Montena et al.
7,128,605 B2 10/2006 Montena
7,131,868 B2 11/2006 Montena
7,179,122 B2 2/2007 Holliday
D538,750 S 3/2007 Montena
7,241,172 B2 7/2007 Rodrigues et al.
7,252,546 B1 8/2007 Holland
7,299,550 B2 11/2007 Montena
7,300,309 B2 11/2007 Montena
7,371,113 B2 5/2008 Burris et al.
7,410,389 B2 8/2008 Holliday
7,455,549 B2 11/2008 Rodrigues et al.
7,458,849 B2 12/2008 Rodrigues et al.
7,458,851 B2 12/2008 Montena
7,513,795 B1 4/2009 Shaw
7,544,094 B1 6/2009 Paglia et al.
7,794,275 B2 9/2010 Rodrigues
7,997,930 B2 8/2011 Ehret et al.
8,342,879 B2 1/2013 Amidon et al.
8,517,764 B2 * 8/2013 Wei ..... H01R 9/0524 439/578
8,568,165 B2 * 10/2013 Wei ..... H01R 13/405 439/578
8,721,365 B2 5/2014 Holland
8,777,661 B2 * 7/2014 Holland ..... H01R 24/38 439/108
8,864,519 B2 * 10/2014 Wei ..... H01R 13/405 439/578
8,944,846 B2 2/2015 Lee
9,306,324 B2 * 4/2016 Wei ..... H01R 13/622
2004/0102089 A1 5/2004 Chee
2004/0110416 A1 6/2004 Montena et al.
2004/0229504 A1 11/2004 Liu
2005/0208827 A1 9/2005 Burris et al.
2006/0194474 A1 8/2006 Montena
2007/0042642 A1 2/2007 Montena et al.
2008/0274644 A1 11/2008 Rodrigues
2009/0163076 A1 6/2009 Paglia et al.
2010/0081321 A1 4/2010 Malloy et al.
2010/0081322 A1 4/2010 Malloy et al.
2010/0233901 A1 9/2010 Wild et al.
2013/0059468 A1 * 3/2013 Wood ..... H01R 9/05 439/584
2013/0130541 A1 * 5/2013 Wei ..... H01R 9/05 439/578
2013/0130545 A1 * 5/2013 Wei ..... H01R 9/0524 439/585
2013/0137300 A1 5/2013 Eriksen et al.
2015/0180141 A1 * 6/2015 Wei ..... H01R 13/622 439/583
2015/0333419 A1 * 11/2015 Eriksen ..... H01R 13/502 439/578

FOREIGN PATENT DOCUMENTS

DE 1191880 B 4/1965
DE 047931 C 5/1966
DE 1515398 B1 4/1970
DE 2225764 A1 12/1972
DE 2221936 A1 11/1973
DE 2261973 A1 6/1974
DE 3211008 A1 10/1983
EP 0072104 A1 2/1983
EP 0116157 A1 8/1984
EP 0167738 A2 1/1986
EP 0265276 A2 4/1988
FR 2232846 A1 1/1975

(56) References Cited

FOREIGN PATENT DOCUMENTS

| | | | |
|---|---|---|---|
| FR | 2234680 | A2 | 1/1975 |
| FR | 2462798 | A1 | 2/1981 |
| GB | 0589697 | A | 6/1947 |
| GB | 1087228 | A | 10/1967 |
| GB | 1270846 | A | 4/1972 |
| GB | 2019665 | A | 10/1979 |
| GB | 2079549 | A | 1/1982 |
| TW | I262638 | B | 9/2006 |
| TW | 200742205 | | 11/2007 |
| WO | 9324973 | A1 | 12/1993 |
| WO | 9608854 | A1 | 3/1996 |
| WO | 0186756 | A1 | 11/2001 |

OTHER PUBLICATIONS

Broadband Library, 2003, 3 pages, Gilbert, USA.
International Search Report and Written Opinion for PCT/US2011/052157, dated Mar. 21, 2012, 9 pages.
Nov. 2, 2017 Office Action Issued in U.S. Appl. No. 15/351,436.

* cited by examiner

CABLE CONNECTOR HAVING A SLIDER FOR COMPRESSION

CROSS REFERENCE TO RELATED APPLICATIONS

This application is a continuation of U.S. patent application Ser. No. 15/351,436, filed Nov. 14, 2016, now U.S. Pat. No. 10,090,610, which is a continuation of U.S. patent application Ser. No. 14/457,498, filed Aug. 12, 2014, now U.S. Pat. No. 9,496,631, which is a continuation of U.S. patent application Ser. No. 14/046,718, filed on Oct. 4, 2013, now U.S. Pat. No. 8,840,429, which is a continuation of U.S. patent application Ser. No. 12/896,156, filed on Oct. 1, 2010, now U.S. Pat. No. 8,556,656. The entire contents of the aforementioned applications are hereby incorporated by reference.

BACKGROUND OF THE INVENTION

Connectors are used to connect coaxial cables to various electronic devices such as televisions, antennas, set-top boxes, satellite television receivers, etc. Conventional coaxial connectors generally include a connector body having an annular collar for accommodating a coaxial cable, and an annular nut rotatably coupled to the collar for providing mechanical attachment of the connector to an external device and an annular post interposed between the collar and the nut. The annular collar that receives the coaxial cable includes a cable receiving end for insertably receiving a coaxial cable and, at the opposite end of the connector body, the annular nut includes an internally threaded end that permits screw threaded attachment of the body to an external device.

This type of coaxial connector also typically includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve.

Conventional coaxial cables 4 typically include a center conductor 44 surrounded by an insulator 46 (or insulated spacer), as shown in FIG. 1A. A conductive foil 48 is disposed over the insulator 46 and a braided conductive shield 50 (or braided conductor) surrounds the foil-covered insulator 46. An outer insulative jacket 52 surrounds the shield 50. In order to prepare the coaxial cable 4 for termination with a connector, the outer jacket 52 is stripped back exposing a portion of the braided conductive shield 50. The exposed braided conductive shield 50 is folded back over the jacket 52. A portion of the insulator 46 covered by the conductive foil 48 extends outwardly from the jacket 52 and a portion of the center conductor 44 extends outwardly from within the insulator 46.

Upon assembly, a coaxial cable is inserted into the cable receiving end of the connector body and the annular post is forced between the foil covered insulator and the conductive shield of the cable. In this regard, the post is typically provided with a radially enlarged barb to facilitate expansion of the cable jacket. The locking sleeve is then moved axially into the connector body to clamp the cable jacket against the post barb providing both cable retention and a water-tight seal around the cable jacket. The connector can then be attached to an external device by tightening the internally threaded nut to an externally threaded terminal or port of the external device.

DETAILED DESCRIPTION OF THE PREFERRED EMBODIMENTS

The following detailed description refers to the accompanying drawings. The same reference numbers in different drawings may identify the same or similar elements. Also, the following detailed description does not limit the invention.

One or more embodiments disclosed herein relate to improved coaxial cable connectors. More specifically, the described cable connectors may include a compressible or deformable body and a post for receiving a prepared end of a coaxial cable between the compressible body and the post. A sliding ring disposed on the compressible body may engage an outer portion of the compressible body element following insertion of the coaxial cable between the post and the compressible body. Continued movement of the sliding ring relative to the compressible body may cause at least a portion of the compressible body to deform inwardly toward the post, thereby securing the coaxial cable to the connector.

Figure 1A:
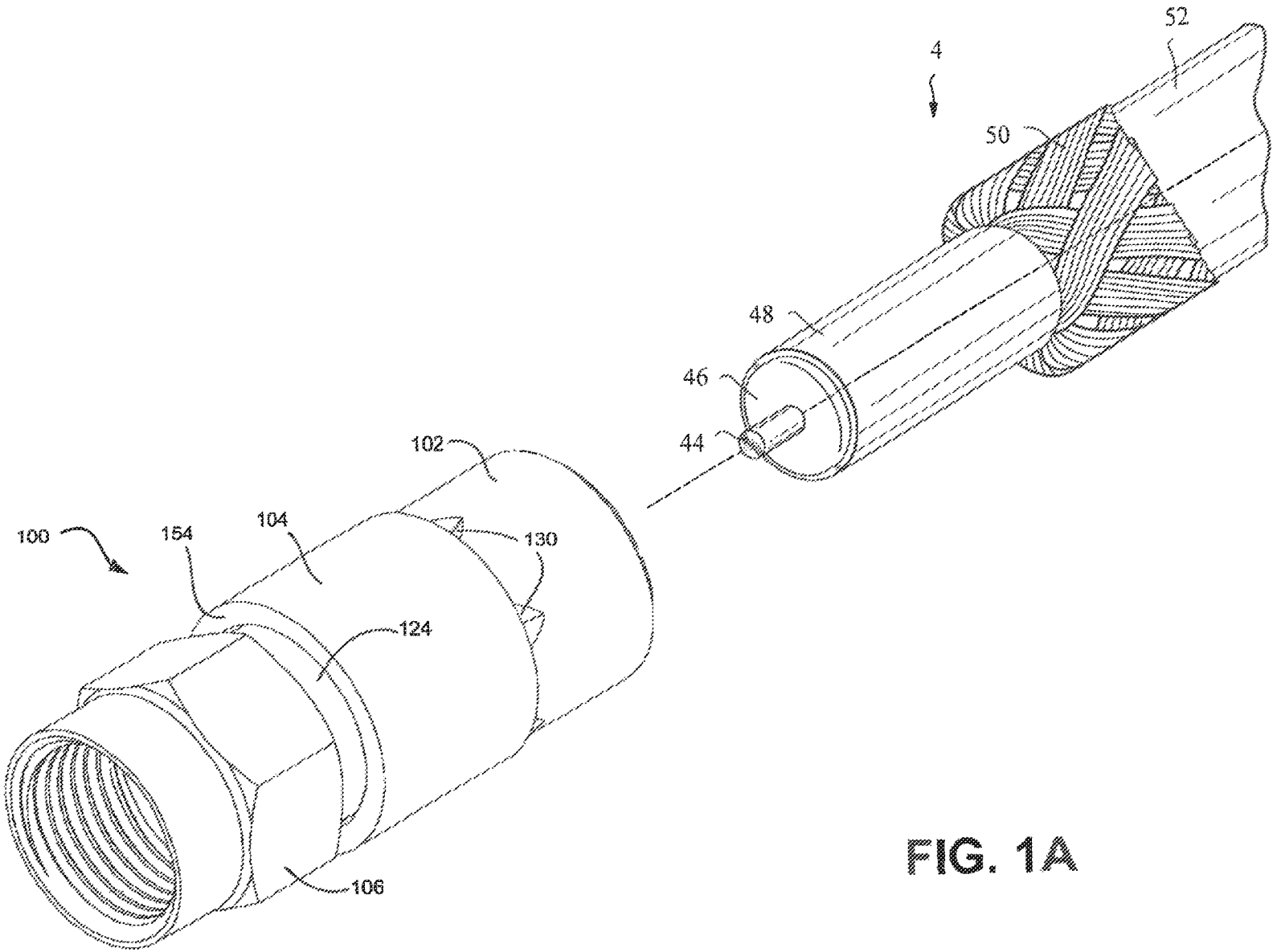
FIG. 1A is an isometric view of an exemplary embodiment of a coaxial cable connector.

FIG. 1A is an isometric view of an exemplary embodiment of a coaxial cable connector 100. As illustrated in FIG. 1A, connector 100 may include a body 102 (or cylindrical casing), a sliding ring 104, and a rotatable nut 106 (i.e. a coupler or locknut).

Figure 1B:
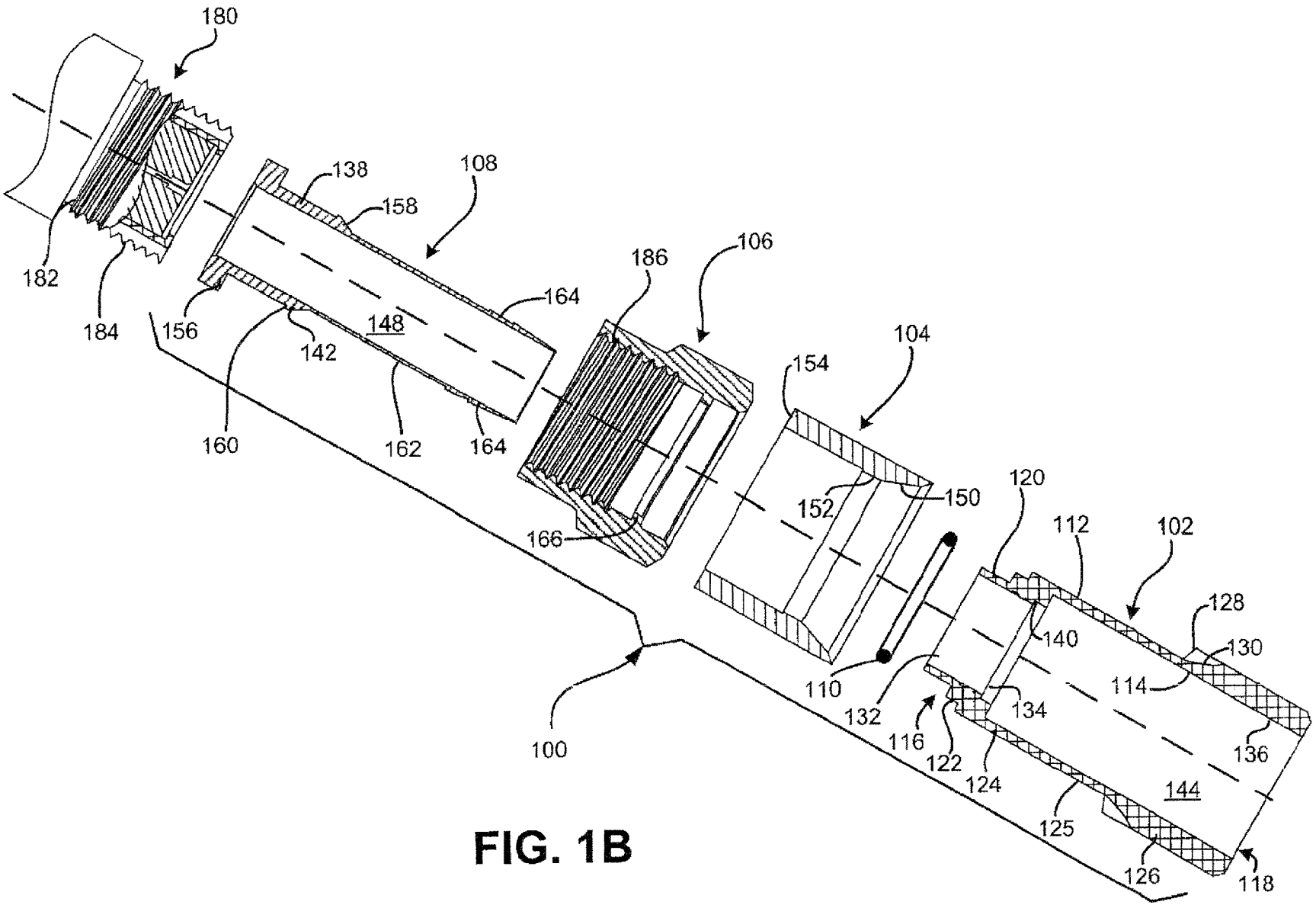
FIG. 1B is an exploded cross-sectional view of the unassembled components of the coaxial cable connector of FIG. 1A.

FIG. 1B is an exploded cross-sectional view of the unassembled components of coaxial cable connector 100 of FIG. 1A. FIG. 1B also shows a cross-sectional view of a port connector 180 to which connector 100 may be connected. Port connector 180 may include a substantially cylindrical body 182 having external threads 184 that match internal threads 186 of rotatable nut 106. Further, as shown in FIG. 1B, in addition to connector body 102, sliding ring 104, and nut 106, connector 100 may also include a post 108 (or inner tube) and an O-ring 110.

Figure 1C:
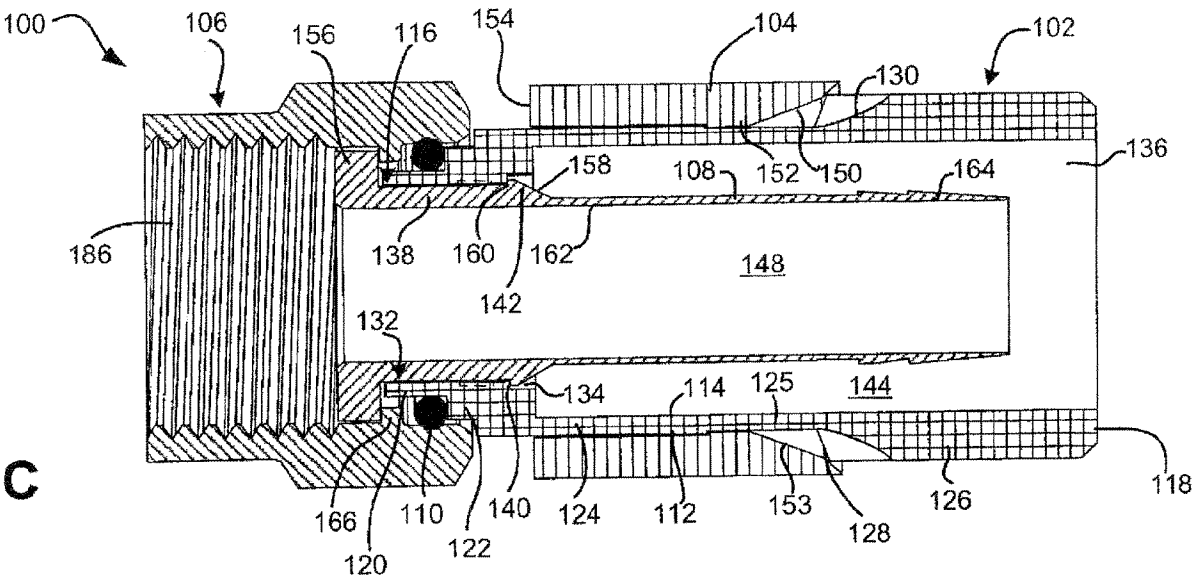
FIG. 1C is a cross-sectional view of the coaxial cable connector of FIG. 1 in an uncompressed configuration.
Figure 1D:
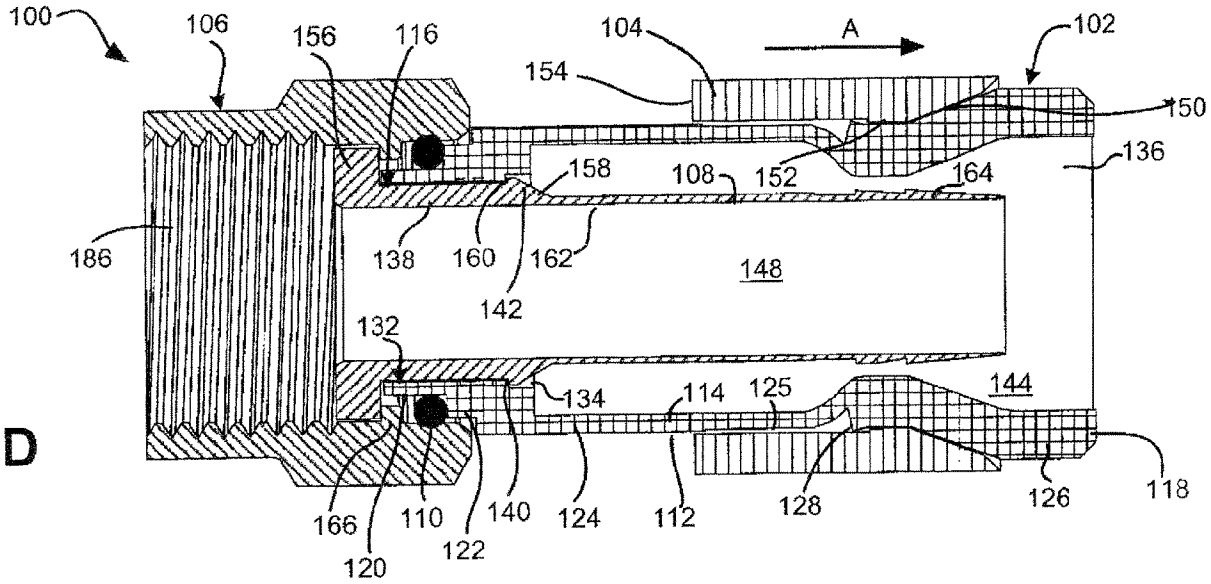
FIG. 1D is a cross-sectional view of the coaxial cable connector of FIG. 1 in a compressed configuration.

FIGS. 1C and 1D are cross-sectional views of coaxial cable connector 100 of FIGS. 1A and 1B in first and second assembled configurations, respectively. As described below, FIG. 1C illustrates connector 100 in the first, unsecured configuration and FIG. 1D illustrates connector 100 in the second, secured configuration. In each of FIGS. 1C and 1D, connector 100 is shown unconnected to port connector 180 or to an end of a coaxial cable (not shown).

As shown in FIGS. 1B-1D, connector body 102 may include an elongated, cylindrical member, formed of a resilient, compressible, or deformable material, such as a soft plastic or semi-rigid rubber material. In exemplary implementations, connector body 102 may be formed of High Density Polyethylene (HDPE) or polypropylene. Connector body 102 may include (1) an outer surface 112, (2) an inner surface 114, (3) a forward end 116 coupled to annular post 108 and rotatable nut 106, and (4) a rear or cable receiving end 118, opposite forward end 116.

In one implementation, forward end 116 of connector body 102 may include a stepped configuration to receive a rearward end of nut 106 thereon. More specifically, as shown in FIG. 1B, forward end 116 of connector body 102 may include a first cylindrical portion 120, a second cylindrical portion 122 having a diameter larger than first cylindrical portion 120, a third cylindrical portion 124 having a diameter larger than second cylindrical portion 122, and a fourth cylindrical portion 125 having a diameter smaller than third cylindrical portion 124. Third and fourth cylindrical portions 124/125 may form an intermediate portion of connector body 102 configured to engage sliding ring 104 in the first position, as shown in FIG. 1C. More specifically, fourth cylindrical portion 125 may form an annular notch in outer surface 112 of third cylindrical portion 124 for engaging a corresponding structure in sliding ring 104 (described below). In one exemplary implementation, the outside diameter of third cylindrical portion 124 may be approximately 0.385 inches.

Cable receiving end 118 may include a fifth cylindrical portion 126 having a diameter larger than third cylindrical portion 124. As shown in FIGS. 1B-1D, a forward end (e.g., toward nut 106) of fifth cylindrical portion 126 may have a sloped or angled surface 128 for providing sliding engagement with a rearward end 150 of sliding ring 104 during movement of sliding ring 104 in a rearward direction A (shown by an arrow in FIG. 1D). For convenience, direction A may be referred to as "rearward," but direction A could be referred to as any direction.

As shown in FIG. 1A, outer surface 112 of fifth cylindrical portion 126 may include a plurality of notches or cut-outs 130 formed therein. More specifically, notches 130 may be formed at regular intervals about the periphery of fifth cylindrical portion 126, such that upon movement of sliding ring 104 in rearward direction A, sliding ring 104 covers notches 130. In an exemplary embodiment, notches 130 may formed as arrow-head shaped cut-outs in outer surface 112, although other shapes may be used.

Inner surface 114 of connector body 102 may include a first tubular portion 132, a second tubular portion 134, and a third tubular portion 136. Tubular portions 132-136 may be concentrically formed within connector body 102 such that post 108 may be received therein during assembly of connector 100. As shown in FIGS. 1C and 1D, first tubular portion 132 may be formed at forward end 116 of connector body 102 and may have an inside diameter approximately equal to an outside diameter of a body engagement portion 138 of post 108. Second tubular portion 134 may have an inside diameter larger than the inside diameter of first tubular portion 132 and may form an annular notch 140 with respect to first tubular portion 132. Annular notch 140 may be configured to receive a body engagement barb 142 formed in post 108.

Third tubular portion 136 may have an inside diameter larger than the inside diameter of second tubular portion 134 and may form a cavity 144 for receiving a tubular extension 162 of post 108. Furthermore, as described below, post 108 may include a tubular cavity 148 therein. During connection of connector 100 to a coaxial cable, tubular cavity 148 may receive a center conductor and dielectric covering of the inserted coaxial cable and cavity 144 may receive a jacket and shield of the inserted cable.

Sliding ring 104 may include a substantially tubular body having a rearward end 150, an inner annular protrusion 152, and a forward end 154. As shown in FIGS. 1C and 1D, sliding ring 104 may have an inside diameter approximately equal to an outside diameter of third cylindrical portion 124 Inner annular protrusion 152 may have an inside diameter approximately equal to an outside diameter of fourth cylindrical portion 125, such that forward movement of sliding ring 104 relative to body 102 is limited by the interface between inner annular protrusion 152 and the substantially perpendicular end of third cylindrical portion 124 (relative to fourth cylindrical portion 125). In an exemplary implementation, an outside diameter of sliding ring 104 may be approximately 0.490 inches and the inside diameter of sliding ring 104 may be approximately 0.413 inches.

Rearward end 150 of sliding ring 104 may include an angled or beveled inner surface 153. One exemplary angle may be approximately 45 degrees, although other suitable angles or slopes may be used. Angled inner surface 153 may be configured to engage fifth cylindrical portion 126 and/or angled surface 128 during rearward movement of sliding ring 104 in direction A.

In an exemplary implementation, sliding ring 104 may be formed of a material having a higher rigidity than that of connector body 102. For example, a plastic material, such as Acetal may be used. In other implementations, a metal such as brass or an injection molded metal alloy (e.g., an Aluminum/Zinc alloy) may be used.

Post 108 may be configured for receipt within body 102 during assembly of connector 100. As illustrated in FIGS. 1B-1D, post 108 may include a flanged base portion 156 at its forward end for securing post 108 within annular nut 106. The outside diameter of flanged base portion 156 may be larger than the inside diameter of first tubular portion 132, thereby limiting insertion of post 108 within body 102 during assembly of connector 100.

Post 108 may include a substantially cylindrical body engagement portion 138 having an outside diameter approximately equal to the inside diameter of first tubular portion 132. A rearward end of body engagement portion 138 may include body engagement barb 142 sized to fit within annular notch 140 during insertion of post 108 within body 102. As shown in FIGS. 1C and 1D, body engagement barb 142 may have an outermost diameter larger than the inside diameter of first tubular portion 132 and smaller than the inside diameter of second tubular portion 134. Moreover, body engagement barb 142 may include a rearward facing angled portion 158 and a forward facing perpendicular portion 160.

During assembly of connector 100, post 108 may be inserted rearwardly within first tubular portion 132, such that angled portion 158 of barb 142 engages first tubular portion 132. Once barb 142 passes to second tubular portion 134, perpendicular portion 160 may abut a rearward perpendicular interface between first tubular portion 132 and second tubular portion 134 to prevent unwanted removal of post 108 from body 102. In some implementations, the variance between the outermost diameter of barb 142 and the inside diameter of first tubular portion 132 may be such that post 108 may be forcibly removed from body 102, if desired.

Post 108 may include a tubular extension 162 projecting rearwardly from body engagement portion 138. In exemplary implementations, an outside diameter of tubular extension 162 may be approximately 0.20 to 0.23 inches. Flanged base portion 156, body engagement portion 138 and tubular extension 162 may together define inner chamber 148 for receiving a center conductor and insulator of an inserted coaxial cable. In one embodiment, the rearward end of tubular extension 162 may include one or more radially outwardly extending ramped flange portions or "barbs" 164 to enhance compression of the outer jacket of the coaxial cable and to secure the cable within connector 100. In some implementations, a rearwardmost barb 164 may form a sharp edge for facilitating the separation of the shield and jacket from the insulator of an inserted coaxial cable.

As shown in FIGS. 1C and 1D, tubular extension 162 of post 108 and third tubular portion 136 of connector body 102 together define annular chamber 144 for accommodating the jacket and shield of an inserted coaxial cable. In exemplary implementations, the distance between the outside diameter of tubular extension 162 and the diameter of third tubular portion 136 is between about 0.0585 to 0.0665 inches. This may also be referred to as the installation opening of connector 100.

As also shown in FIGS. 1C and 1D, following assembly of post 108 into connector body 102, a rearward end of tubular extension 162 may be recessed with respect to an end of cable receiving end 118 of connector body 102. In one implementation, post 108 may be recessed into connector body 102 by a distance of approximately 0.110 inches.

Annular nut 106 may be rotatably coupled to forward end 116 of connector body 102 Annular nut 106 may include any number of attaching mechanisms, such as that of a hex nut, a knurled nut, a wing nut, or any other known attaching means, and may be rotatably coupled to connector body 102 for providing mechanical attachment of connector 100 to an external device, e.g., port connector 180, via a threaded relationship. As illustrated in FIGS. 1C and 1D, nut 106 may include an annular flange 166 configured to fix nut 106 axially relative to post 108 and connector body 102.

More specifically, annular flange 166 may project from an inner surface of nut 106 and may include an inside diameter smaller than the outside diameter of flanged base portion 156 and the outside diameter of second cylindrical portion 122 of body 102. During assembly of connector 100, post 108 may be initially inserted within nut 106 and then within first tubular portion 132 in the manner described above. Once body engagement barb 142 engages the rearward perpendicular interface between first tubular portion 132 and second tubular portion 134, nut 106 becomes axially trapped or fixed between flanged base portion 156 and body 102.

In one embodiment, O-ring 110 (e.g., a resilient sealing O-ring) may be positioned within annular nut 106 (e.g., adjacent to annular flange 166) to provide a substantially water-resistant seal between connector body 102 and annular nut 106.

Connector 100 may be supplied in an assembled condition, as shown in FIG. 1C, in which sliding ring 104 is installed on connector body 102 in a forward (e.g., uncompressed) position. A prepared end of a coaxial cable may be received through cable receiving end 118 of body 102 to engage post 108 of connector 100, as described above. Once the prepared end of the coaxial cable is inserted into connector body 102 so that the cable jacket is separated from the insulator by the sharp edge of post 108, sliding ring 104 may be moved axially rearward in direction A from the first position (shown in FIG. 1C) to the second position (shown in FIG. 1D). In some embodiments, a compression tool may be used to advance sliding ring 104 from the first position to the second position.

As sliding ring 104 moves axially rearward in direction A, angled rearward end 150 of sliding ring 104 may engage the outer surface of fifth cylindrical portion 126, thereby forcing fifth cylindrical portion 126 radially inward toward post 108 and compressing the shield/jacket of the coaxial cable against post 108. Notches 130 in the outer surface of fifth cylindrical portion 126 may facilitate the radial compression of fifth cylindrical portion 126.

As shown in FIG. 1D, upon continued rearward movement of sliding ring 104, a portion of sloped surface 128 may be received within the tubular body of sliding ring 104 adjacent to inner annular protrusion 152. The engagement of sloped surface 128 with the tubular body of sliding ring 104 (i.e. combining to form a retainer) may assist in maintaining sliding ring 104 in the second position. In other instances, a friction relationship between fifth cylindrical portion 126 may be sufficient to maintain sliding ring 104 in the second position following securing of a coaxial cable to connector 100. As shown in FIG. 1D, when sliding ring 104 is in the second position, rearward end 150 may be spaced from an end of cable receiving end 118. In one exemplary implementation, rearward end 150 may be spaced from the end of cable receiving end 118 by approximately 0.120 inches.

Figure 2A:
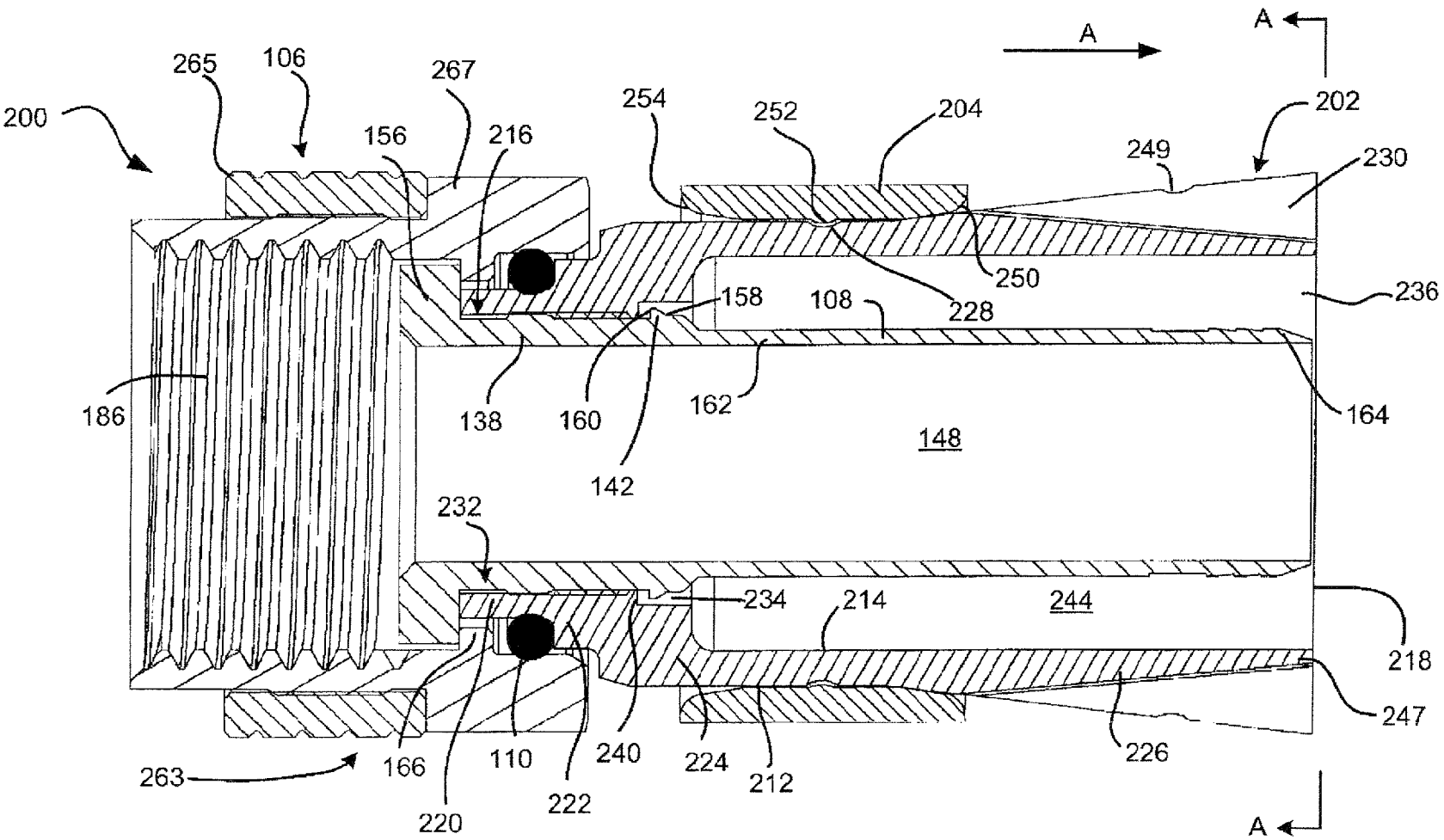
FIG. 2A is a cross-sectional view of another exemplary coaxial cable connector in an uncompressed configuration.
Figure 2C:
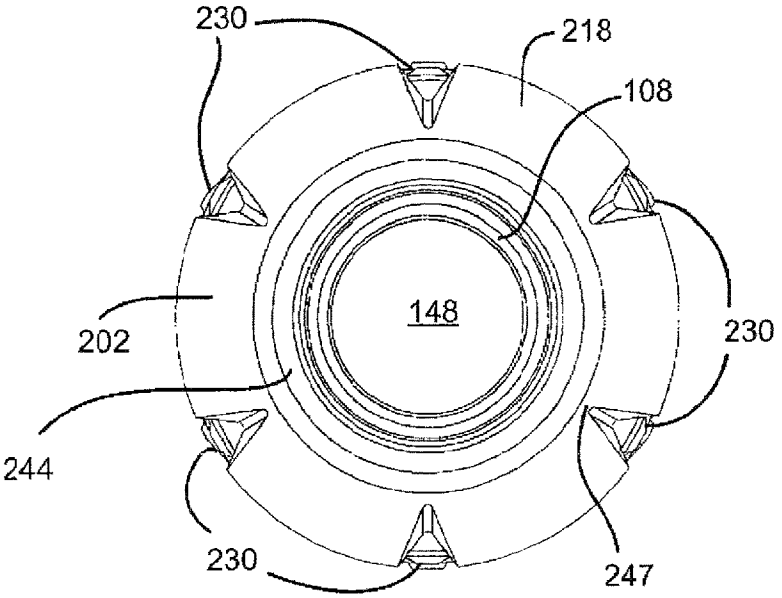
FIG. 2C is an end view of the coaxial cable connector of FIG. 2A taken along the line A-A in FIG. 2A.
Figure 2B:
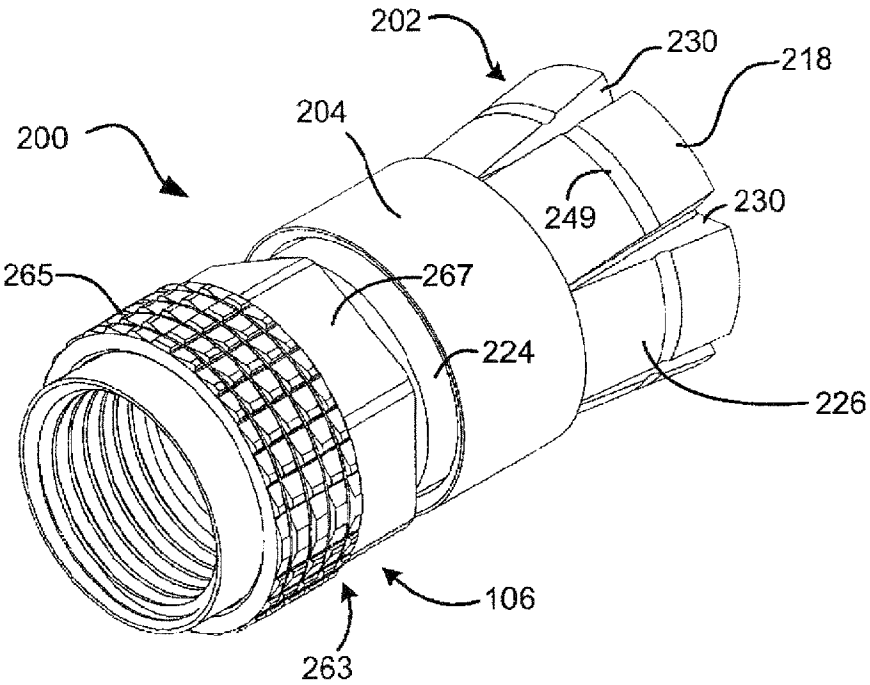
FIG. 2B is an isometric view of the coaxial cable connector of FIG. 2A.

Referring now to FIGS. 2A-2C, another alternative implementation of a connector 200 is illustrated. The embodiment of FIGS. 2A-2C is similar to the embodiment illustrated in FIGS. 1A-1D, and similar reference numbers are used where appropriate. In the embodiment of FIGS. 2A-2C, connector 200 may include connector body 202, sliding ring 204, nut 106, post 108, and O-ring 110.

Connector body 202, similar to connector body 102 of FIGS. 1A-1D, may include an elongated, cylindrical member, formed of a resilient, compressible, or deformable material, such as a soft plastic or semi-rigid rubber material.

Connector body 202 may include (1) outer surface 212, (2) inner surface 214, (3) forward end 216 coupled to annular post 108 and rotatable nut 106, and (4) cable receiving end 218, opposite forward end 216.

In one implementation, forward end 216 of connector body 202 may include a stepped configuration to receive a rearward end of nut 106 thereon. More specifically, as shown in FIG. 2A, forward end 216 of connector body 202 may include a first cylindrical portion 220, a second cylindrical portion 222 having a diameter larger than first cylindrical portion 220, a third cylindrical portion 224 having a diameter larger than second cylindrical portion 222, and a flared or ramped end portion 226 extending from third cylindrical portion 222 to cable receiving end 218 of connector body 202. As shown, an initial outside diameter of flared end portion 226 may be substantially equal to the outside diameter of third cylindrical portion 222. In one embodiment, a peak outside diameter of flared end portion 226 (e.g., proximal to cable receiving end 218) may be approximately 0.09 inches larger than the outside diameter of third cylindrical portion 222.

As shown in FIG. 2A, third cylindrical portion 224 of body 202 may include a first annular groove 228 Annular groove 228 may mate with a corresponding annular protrusion 252 in sliding ring 204 to maintain sliding ring 204 in the first (e.g., non-compressed) position prior to compression of connector 200.

Flared end portion 226 may include a plurality of axial notches 230 formed therein, as best shown in FIGS. 2B and 2C. In one exemplary embodiment, each of axial notches 230 may be substantially V-shaped and may be formed in a spaced relationship along an outer surface of flared end portion 226. Notches 230 may extend from an interface of flared end portion 226 with third cylindrical portion 224 to an end of flared end portion 226. In an exemplary implementation, notches 230 may have a maximum width of approximately 0.170 to 0.040 inches. In one implementation, connector body 202 may include six notches 230, however any suitable number of notches 230 may be provided.

Inner surface 214 of connector body 202 may include a first tubular portion 232, a second tubular portion 234, and a third tubular portion 236. Tubular portions 232-236 may be concentrically formed within connector body 202 such that post 108 may be received therein during assembly of connector 200. As shown in FIG. 2A, first tubular portion 232 may be formed at forward end 216 of connector body 202 and may have an inside diameter approximately equal to an outside diameter of a body engagement portion 138 of post 108. Second tubular portion 234 may have an inside diameter larger than the inside diameter of first tubular portion 232 and may form an annular notch 240 with respect to first tubular portion 232 Annular notch 240 may be configured to receive a body engagement barb 142 formed in post 108.

Third tubular portion 236 may have an inside diameter larger than the inside diameter of second tubular portion 234 and may form a cavity 244 for receiving a tubular extension 162 of post 108. Furthermore, as described below, post 108 may include a tubular cavity 148 therein. During connection of connector 200 to a coaxial cable, tubular cavity 148 may receive a center conductor and dielectric covering of the inserted coaxial cable and cavity 244 may receive a jacket and shield of the inserted cable.

As shown in FIGS. 2A and 2C, in an exemplary implementation, each of notches 230 may terminate a predetermined distance from the inside diameter of third tubular portion 236 thereby forming a continuous cylindrical inner surface 247 in an end of third tubular portion 236. In one exemplary embodiment, the predetermined distance may be approximately 0.011 inches. Upon compression of flared end portion 226, cylindrical inner surface 247 may form a continuous moisture seal about the inserted end of the coaxial cable, thereby preventing moisture from entering cavity 244 or tubular cavity 148.

Flared end portion 226 of body 202 may include a second annular groove 249. Second annular groove 249 may mate with corresponding annular protrusion 252 in sliding ring 204 to maintain sliding ring 204 in the second (e.g., compressed) position following compression of connector 200.

Sliding ring 204 may include a substantially tubular body having a rearward end 250, an inner annular protrusion 252, and a forward end 254. As shown in FIGS. 1C and 1D, sliding ring 204 may have an inside diameter approximately equal to an outside diameter of third cylindrical portion 224 Inner annular protrusion 252 may project from the inside of sliding ring 204 and may have an inside diameter approximately equal to an outside diameter of first annular groove 228, such that undesired rearward movement of sliding ring 204 relative to body 202 is minimized or limited.

Rearward end 250 of sliding ring 204 may include an angled, curved, or beveled surface. This curved surface may be configured to engage flared end 226 during rearward movement of sliding ring 204 in direction A to prevent or reduce damage caused to connector body 202 during rearward movement of sliding ring 204.

In an exemplary implementation, sliding ring 204 may be formed of a material having a higher rigidity than that of connector body 202. For example, a plastic material, such as Acetal may be used. In other implementations, a metal such as brass or an injection molded metal alloy (e.g., an Aluminum/Zinc alloy) may be used.

As described above in relation to FIGS. 1A-1D, post 108 may be configured for receipt within body 202 during assembly of connector 200 and may include flanged base portion 156, body engagement portion 138 having a body engagement barb 142, and tubular extension 162 projecting rearwardly from body engagement portion 138. Flanged base portion 156, body engagement portion 138 and tubular extension 162 together define inner chamber 148 for receiving a center conductor and insulator of an inserted coaxial cable. As shown in FIG. 2A, in one implementation, the rearward end of tubular extension 162 may include a plurality of "barbs" 164 to enhance compression of the outer jacket of the coaxial cable and to secure the cable within connector 200.

Tubular extension 162 of post 108 and third tubular portion 236 of connector body 202 together define annular chamber 244 for accommodating the jacket and shield of an inserted coaxial cable. In exemplary implementations, the distance between the outside diameter of tubular extension 162 and the diameter of third tubular portion 236 is between about 0.0585 to 0.0665 inches. This may also be referred to as the installation opening of connector 200.

As also shown in FIG. 2A, following assembly of post 108 into connector body 202, a rearward end of tubular extension 162 may be recessed substantially even or flush with respect to an end of cable receiving end 218 of connector body 202.

Similar to annular nut 106 described above in relation to FIGS. 1A-1D, annular nut 106 in FIGS. 2A-2C may be rotatably coupled to forward end 216 of connector body 202. Annular nut 106 may include any number of attaching mechanisms, such as that of a hex nut, a knurled nut, a wing nut, or any other known attaching means, and may be rotatably coupled to connector body 202 for providing mechanical attachment of connector 200 to an external device, e.g., port connector 180, via a threaded relationship. As illustrated in FIGS. 2B, in an exemplary implementation, annular nut 106 may include a two-part user engagement portion 263 that includes a hand turning portion 265, and a tool turning portion 267 for engaging a tool, such as a socket or wrench.

Connector 200 may be supplied in an assembled condition, as shown in FIG. 2A, in which sliding ring 204 is installed on connector body 202 in a forward (e.g., uncompressed) position. A prepared end of a coaxial cable may be received through cable receiving end 218 of body 202 to engage post 108 of connector 200, as described above. Once the prepared end of the coaxial cable is inserted into connector body 202 so that the cable jacket is separated from the insulator by the sharp edge of post 108, sliding ring 204 may be moved axially rearward in direction A from the first position (shown in FIG. 2A) to a second position (not shown). In some embodiments, a compression tool may be used to advance sliding ring 204 from the first position to the second position.

As sliding ring 204 moves axially rearward in direction A, curved rearward end 250 of sliding ring 204 may engage the outer surface of flared end portion 226, thereby forcing flared end portion 226 radially inward toward post 108 and compressing the shield/jacket of the coaxial cable against post 108. Notches 230 in the outer surface of flared end portion 226 may facilitate the radial compression of flared end portion 226 by providing a number of collapsing regions on an outer surfaced of flared end portion 226.

Upon continued rearward movement of sliding ring 204, annular protrusion 252 in sliding ring 204 may engage second annular groove 249 in flared end 226 (i.e., combining to form a retainer) to maintain sliding ring 204 in the second (e.g., compressed) position. In other implementations, a friction relationship between flared end portion 226 and sliding ring 204 may be sufficient to maintain sliding ring 204 in the second position following securing of a coaxial cable to connector 200.

Figure 3A:
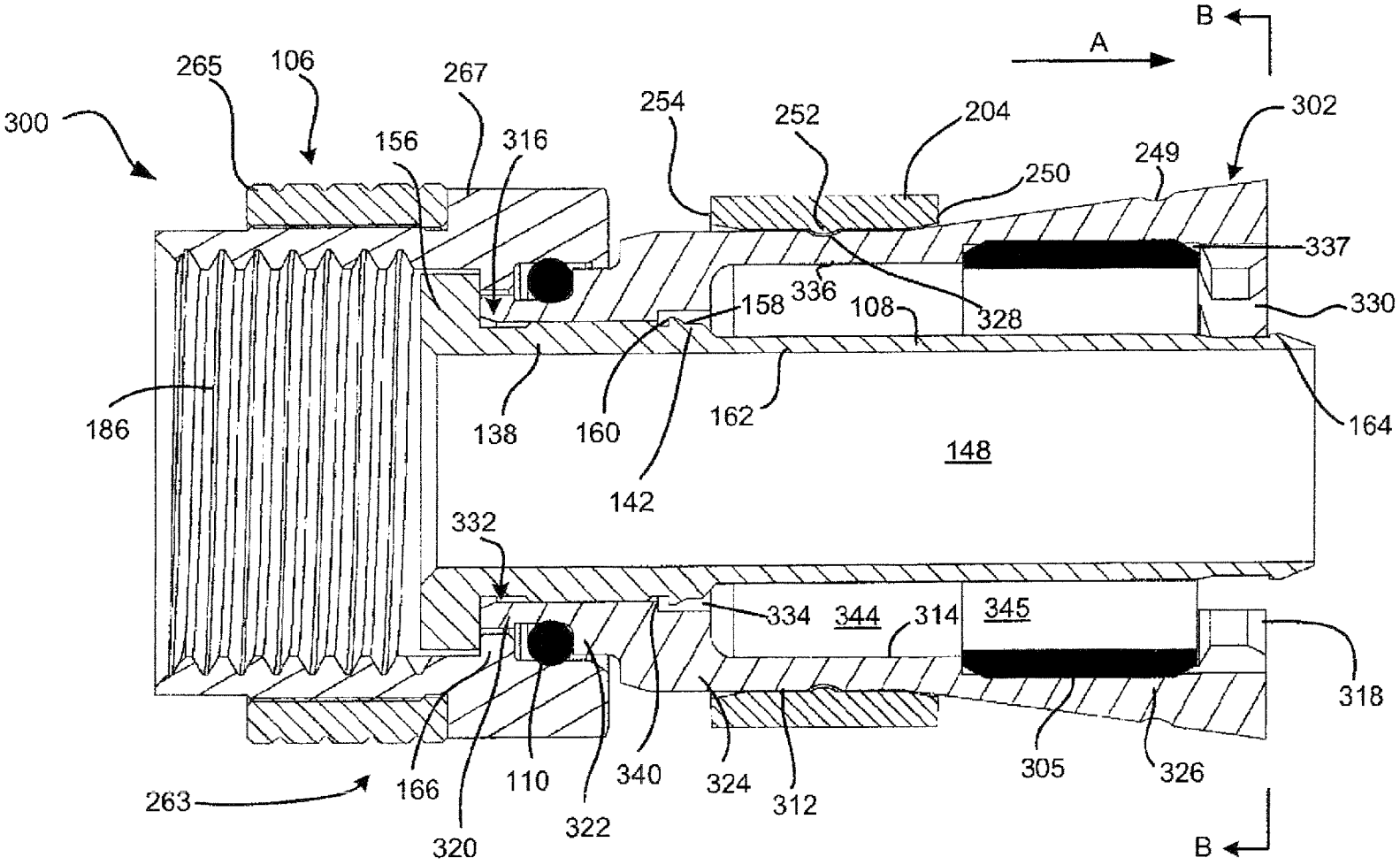
FIG. 3A is a cross-sectional view of yet another exemplary coaxial cable connector in an uncompressed configuration.
Figure 3C:
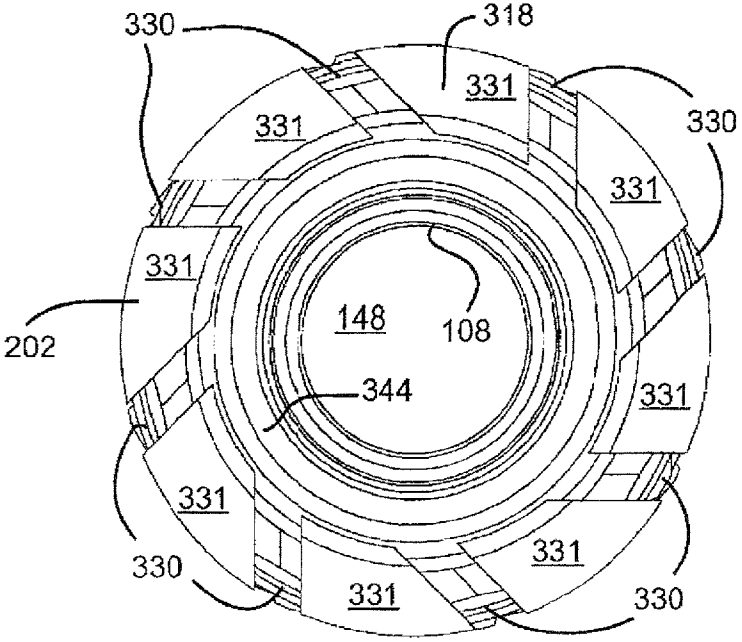
FIG. 3C is a end view of the coaxial cable connector of FIG. 3A taken along the line B-B in FIG. 3A.
Figure 3B:
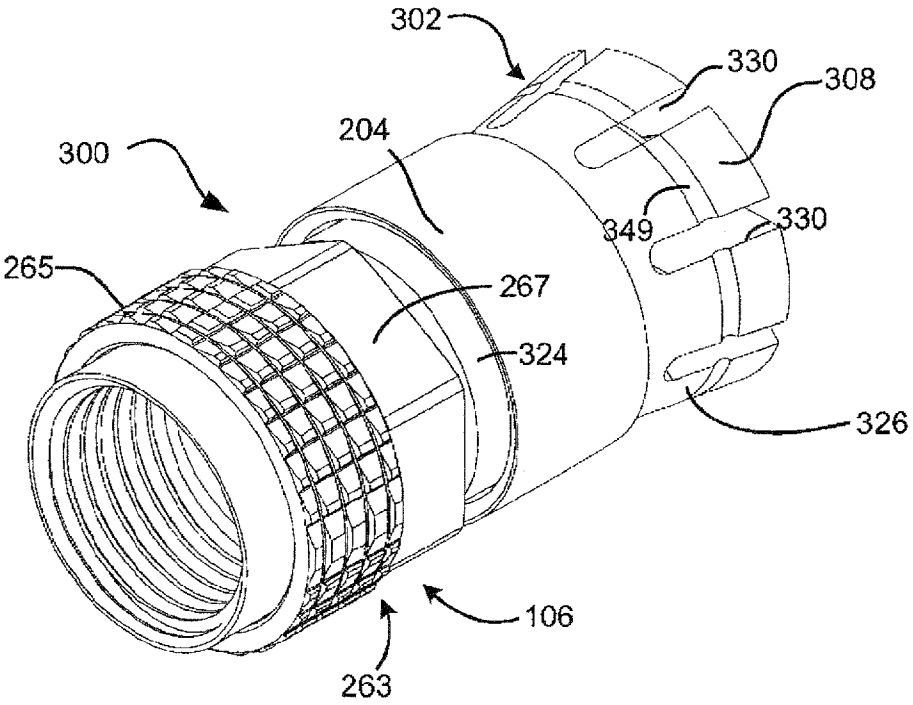
FIG. 3B is an isometric views of the coaxial cable connector of FIG. 3A.

Referring now to FIGS. 3A-3C, yet another alternative implementation of a connector 300 is illustrated. The embodiment of FIGS. 3A-3C is similar to the embodiments described above and similar reference numbers are used where appropriate. In the embodiment of FIGS. 3A-3C, connector 300 may include connector body 302, sliding ring 204, inner collar 305, nut 106, post 108, and O-ring 110.

Connector body 302, similar to connector body 102 of FIGS. 1A-1D, may include an elongated, cylindrical member, formed of a resilient, compressible, or deformable material, such as a soft plastic or semi-rigid rubber material. Connector body 302 may include (1) outer surface 312, (2) inner surface 314, (3) forward end 316 coupled to annular post 108 and rotatable nut 106, and (4) cable receiving end 318, opposite forward end 316.

In one implementation, forward end 316 of connector body 302 may include a stepped configuration to receive a rearward end of nut 106 thereon. More specifically, as shown in FIG. 3A, forward end 316 of connector body 302 may include a first cylindrical portion 320, a second cylindrical portion 322 having a diameter larger than first cylindrical portion 320, a third cylindrical portion 324 having a diameter larger than second cylindrical portion 322, and a flared or ramped end portion 326 extending from third cylindrical portion 322 to cable receiving end 318 of connector body 302. As shown, an initial outside diameter of flared end portion 326 may be substantially equal to the outside diameter of third cylindrical portion 322. In one embodiment, a peak outside diameter of flared end portion 326 (e.g., proximal to cable receiving end 318) may be approximately 0.09 inches larger than the outside diameter of third cylindrical portion 322. In other instances, the angle of flared end portion 326 may be approximately 6-10 degrees (e.g., 8 degrees) with respect to the longitudinal axis of connector 300. This low angle, allows sliding ring 204 to easily move between the uncompressed and compressed positions.

As shown in FIG. 3A, third cylindrical portion 324 of body 302 may include a first annular groove 328 Annular groove 328 may mate with a corresponding annular protrusion 252 in sliding ring 204 to maintain sliding ring 204 in the first (e.g., non-compressed) position prior to compression of connector 300.

In addition, flared end portion 326 may include a plurality of axial slots 330 formed therein, as best shown in FIGS. 3B and 3C. In one exemplary embodiment, each of axial slots 330 may extend through flared end portion 326 at an angle relative to an imaginary line extending radially from a central axis of connector body 302. As shown in FIG. 3C, the effect of forming angled slots 330 through flared end portion 326 is to create a number of substantially turbine-like fingers 331, where slots 330/fingers 331 appear to extend substantially tangentially from an outer diameter of post 108.

Slots 330/fingers 331 may have an angle of approximately 45 degrees and a width of approximately 0.025 to 0.050 inches. Similar to notches 230 described above, slots 330/fingers 331 may allow flared end portion 326 to collapse or compress in on itself (e.g., collapse) in a uniform manner when sliding ring 204 is moved from the uncompressed position (shown in FIGS. 3A-3C) to the compressed position (not shown). Furthermore, the angled nature of slots 330/fingers 331 allow flared end portion 326 to collapse while maintaining a consistently circular inside diameter. Furthermore, the slots 330/fingers 331 may reduce tool compression forces for a range of cable sizes by allowing fingers 331 to slide across each other by differing amounts depending on the size cable inserted.

In one exemplary implementation, slots 330/fingers 331 may extend from an interface of flared end portion 326 with third cylindrical portion 324 to an end of flared end portion 326. In one implementation, connector body 302 may include eight slots 330/fingers 331, however any suitable number of slots 330/fingers 331 may be provided (e.g., between six and twelve slots 330/fingers 331).

Inner surface 314 of connector body 302 may include a first tubular portion 332, a second tubular portion 334, a third tubular portion 336, and a fourth tubular portion 337. Tubular portions 332-337 may be concentrically formed within connector body 302 such that post 108 may be received therein during assembly of connector 300. As shown in FIG. 3A, first tubular portion 332 may be formed at forward end 316 of connector body 302 and may have an inside diameter approximately equal to an outside diameter of a body engagement portion 138 of post 108. Second tubular portion 334 may have an inside diameter larger than the inside diameter of first tubular portion 332 and may form an annular notch 340 with respect to first tubular portion 332. Annular notch 340 may be configured to receive a body engagement barb 142 formed in post 108.

Third tubular portion 336 may have an inside diameter larger than the inside diameter of second tubular portion 334 and may form a forward cavity 344 for receiving a tubular extension 162 of post 108. Furthermore, as described below, post 108 may include a tubular cavity 148 therein. During connection of connector 300 to a coaxial cable, tubular cavity 148 may receive a center conductor and dielectric covering of the inserted coaxial cable and forward cavity 344 may receive a jacket and shield of the inserted cable.

Fourth tubular portion 337 may have an inside diameter larger than the inside diameter of third tubular portion 336 and may form rearward cavity 345 for receiving a rearward portion of tubular extension 162. As shown in FIG. 3A, the increased inside diameter of fourth tubular portion 337 may form an annular notch in cavity 345 for receiving inner collar 305 therein.

Inner collar 305 may be formed of a resilient or flexible material capable of uniformly compressing about the jacket and shield of the inserted cable. The resilient nature of inner collar 305 may form an effective seal between connector body 302 and the jacket and shield of the inserted cable, thereby preventing moisture from entering cavities 344/345 or tubular cavity 148 in post 108. In some implementations, collar 305 may be co-injection molded into place within connector body 302.

In exemplary implementations, inner collar 305 may be formed of a rubber material, such as Santoprene or a resilient plastic or polymer material such as nylon 66. In one implementation, inner collar 305 may have a thickness of approximately 0.020 to 0.040 inches and have a length long enough to cover slots 230. In addition, as shown in FIG. 3, inner collar 305 may terminate forward of the forward end of slots 230.

Flared end portion 326 of body 302 may include a second annular groove 349 formed in an intermediate exterior portion thereof. Second annular groove 349 may mate with corresponding annular protrusion 252 in sliding ring 204 to maintain sliding ring 204 in the second (e.g., compressed) position following compression of connector 300.

Sliding ring 204 in FIGS. 3A-3C may be substantially similar to sliding ring 204 described above with respect to FIGS. 2A-2C. That is, sliding ring 204 may include tubular body having rearward end 250, an inner annular protrusion 252, and forward end 254. As shown in FIGS. 3A, sliding ring 204 may have an inside diameter approximately equal to an outside diameter of third cylindrical portion 324. Inner annular protrusion 252 may project from the inside of sliding ring 204 and may have an inside diameter approximately equal to an outside diameter of first annular groove 328, such that undesired rearward movement of sliding ring 204 relative to connector body 302 is minimized or limited.

As described above in relation to FIGS. 1A-1D and FIGS. 2A-2C, post 108 may be configured for receipt within body 302 during assembly of connector 300 and may include flanged base portion 156, body engagement portion 138 having a body engagement barb 142, and tubular extension 162 projecting rearwardly from body engagement portion 138. Flanged base portion 156, body engagement portion 138 and tubular extension 162 together define inner chamber 148 for receiving a center conductor and insulator of an inserted coaxial cable. As shown in FIG. 3A, in one implementation, the rearward end of tubular extension 162 may include barb 164 to enhance compression of the outer jacket of the coaxial cable and to secure the cable within connector 300.

Tubular extension 162 of post 108, third tubular portion 336, and fourth tubular portion 337 of connector body 302 together define annular cavities 344/345 for accommodating the jacket and shield of an inserted coaxial cable. In exemplary implementations, the distance between the outside diameter of tubular extension 162 and the diameter of inside diameter of inner collar 305 is between about 0.0585 to 0.0665 inches. This may also be referred to as the installation opening of connector 300.

In one implementation, as shown in FIG. 3A, following assembly of post 108 into connector body 302, a rearward end of tubular extension 162 may extend beyond an end of cable receiving end 318 of connector body 302. For example, tubular extension 162 may extend approximately 0.030 inches beyond an end of cable receiving end 318. This configuration increases the visibility of post 108 in connector 300 during installation of a coaxial cable therein.

Figure 4:
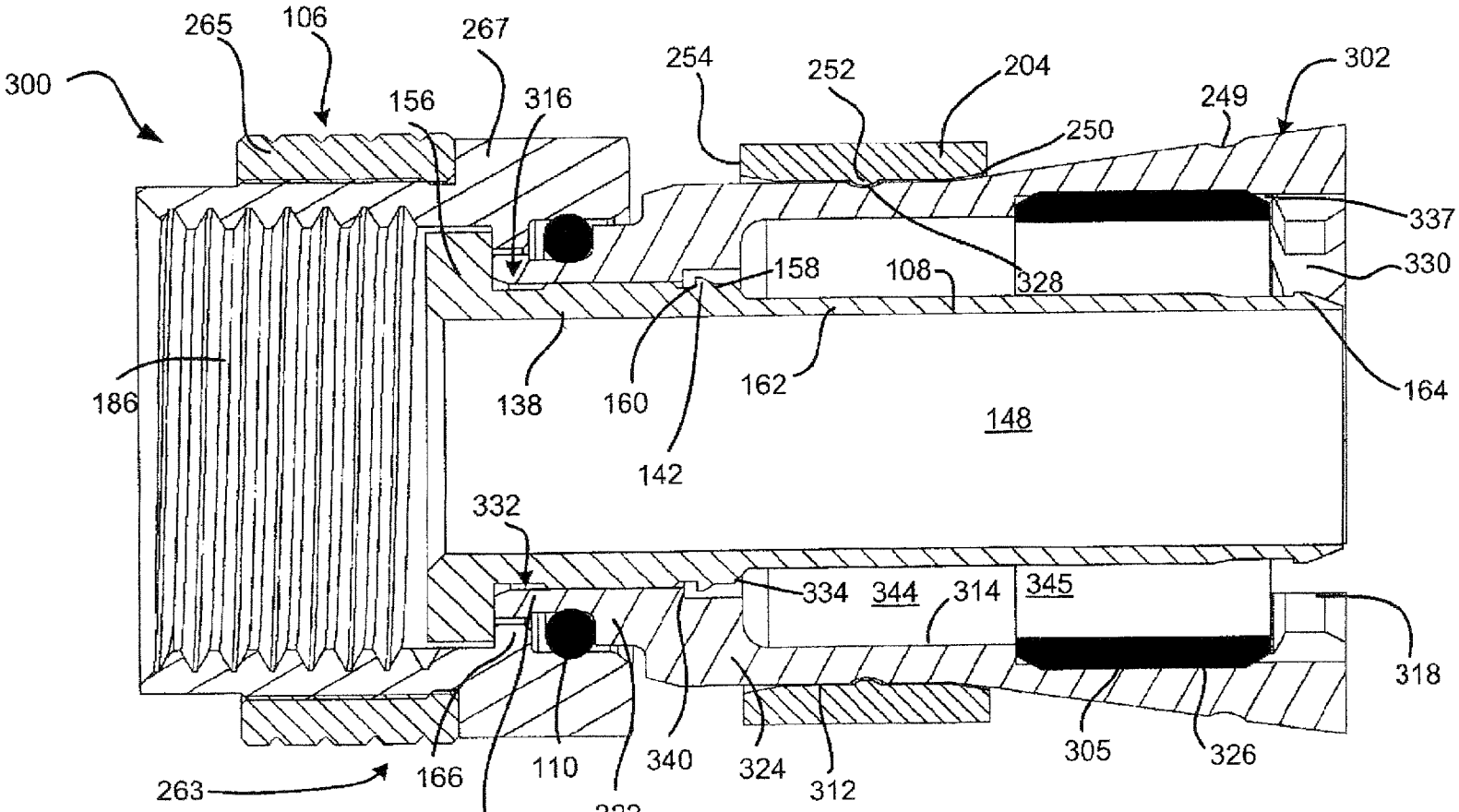
FIG. 4 is a cross-sectional view of still another exemplary coaxial cable connector in an uncompressed configuration.

In other implementations, as shown in FIG. 4, an end of tubular extension 162 may be substantially even or flush with respect to an end of cable receiving end 318 of connector body 302.

Similar to annular nut 106 described above in relation to FIGS. 1A-1D and FIGS. 2A-2C, annular nut 106 in FIGS. 3A-3C and 4 may be rotatably coupled to forward end 316 of connector body 302. Annular nut 106 may include any number of attaching mechanisms, such as that of a hex nut, a knurled nut, a wing nut, or any other known attaching means, and may be rotatably coupled to connector body 302 for providing mechanical attachment of connector 300 to an external device, e.g., port connector 180, via a threaded relationship. As illustrated in FIGS. 3B, in an exemplary implementation, annular nut 106 may include a two-part user engagement portion 263 that includes a hand turning portion 265, and a tool turning portion 267 for engaging a tool, such as a socket or wrench.

Connector 300 may be supplied in an assembled condition, as shown in FIG. 3A, in which sliding ring 204 is installed on connector body 302 in a forward (e.g., uncompressed) position. A prepared end of a coaxial cable may be received through cable receiving end 318 of body 302 to engage post 108 of connector 200, as described above. Once the prepared end of the coaxial cable is inserted into connector body 302 so that the cable jacket is separated from the insulator by the sharp edge of post 108, sliding ring 204 may be moved axially rearward in direction A from the first position (shown in FIG. 3A) to a second position (not shown). In some embodiments, a compression tool may be used to advance sliding ring 204 from the first position to the second position.

As sliding ring 204 moves axially rearward in direction A, curved rearward end 250 of sliding ring 204 may engage the outer surface of flared end portion 326, thereby forcing flared end portion 326 radially inward toward post 108 and simultaneously compressing inner collar 305. This uniformly compresses the shield/jacket of the coaxial cable against post 108 and forms a watertight seal between connector body 302 and the shield/jacket of the coaxial cable. Slots 330 in the outer surface of flared end portion 326 may facilitate the radial compression of flared end portion 326 by providing a number of collapsing regions on an outer surfaced of flared end portion 326.

Upon continued rearward movement of sliding ring 204, annular protrusion 252 in sliding ring 204 may engage second annular groove 349 in flared end 326 (i.e. combining to form a retainer) to maintain sliding ring 204 in the second (e.g., compressed) position. In other implementations, a friction relationship between flared end portion 326 and sliding ring 204 may be sufficient to maintain sliding ring 204 in the second position following securing of a coaxial cable to connector 300.

Figure 5A:
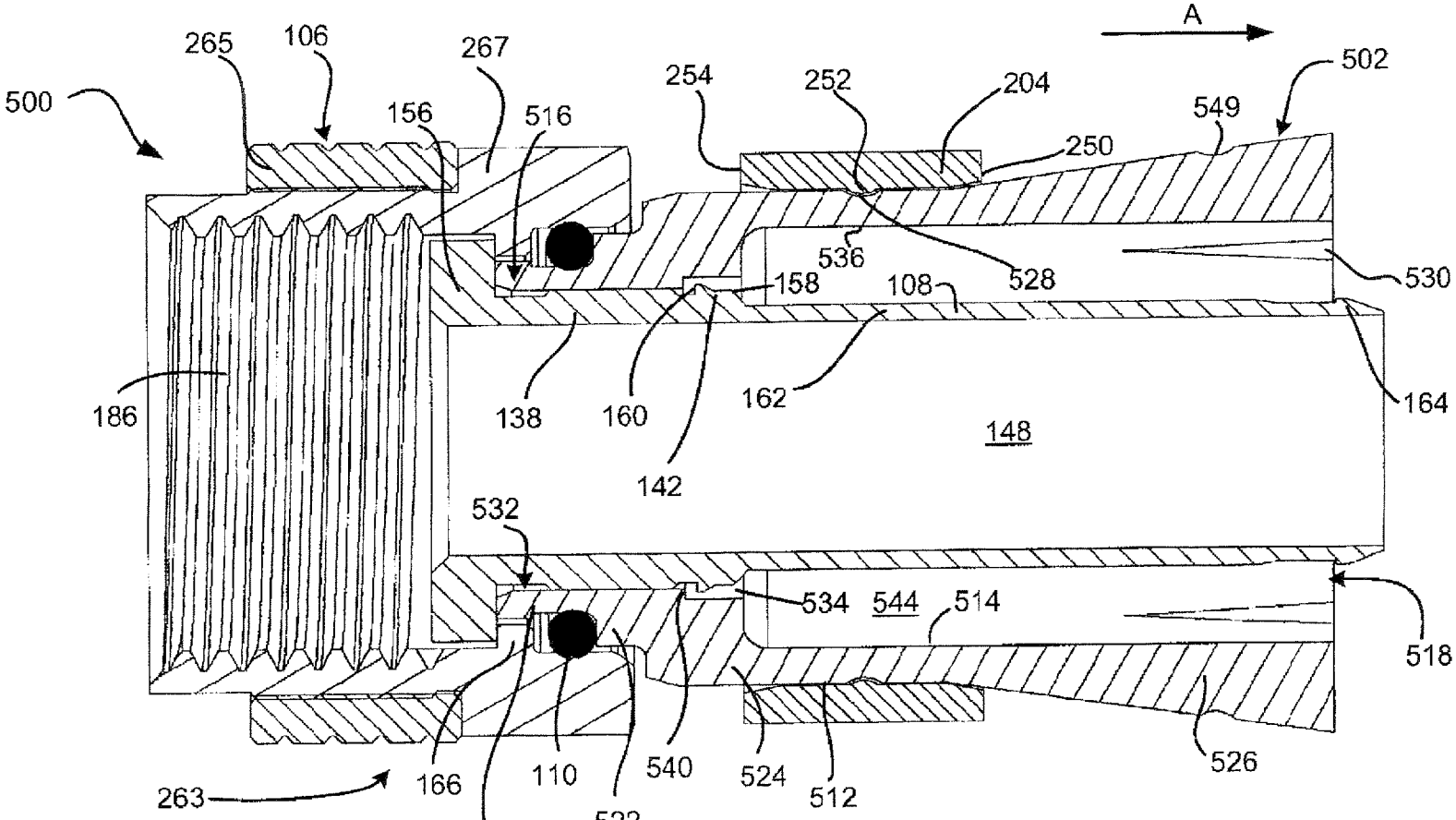
FIG. 5A is a cross-sectional view of another exemplary coaxial cable connector in an uncompressed configuration.
Figure 5C:
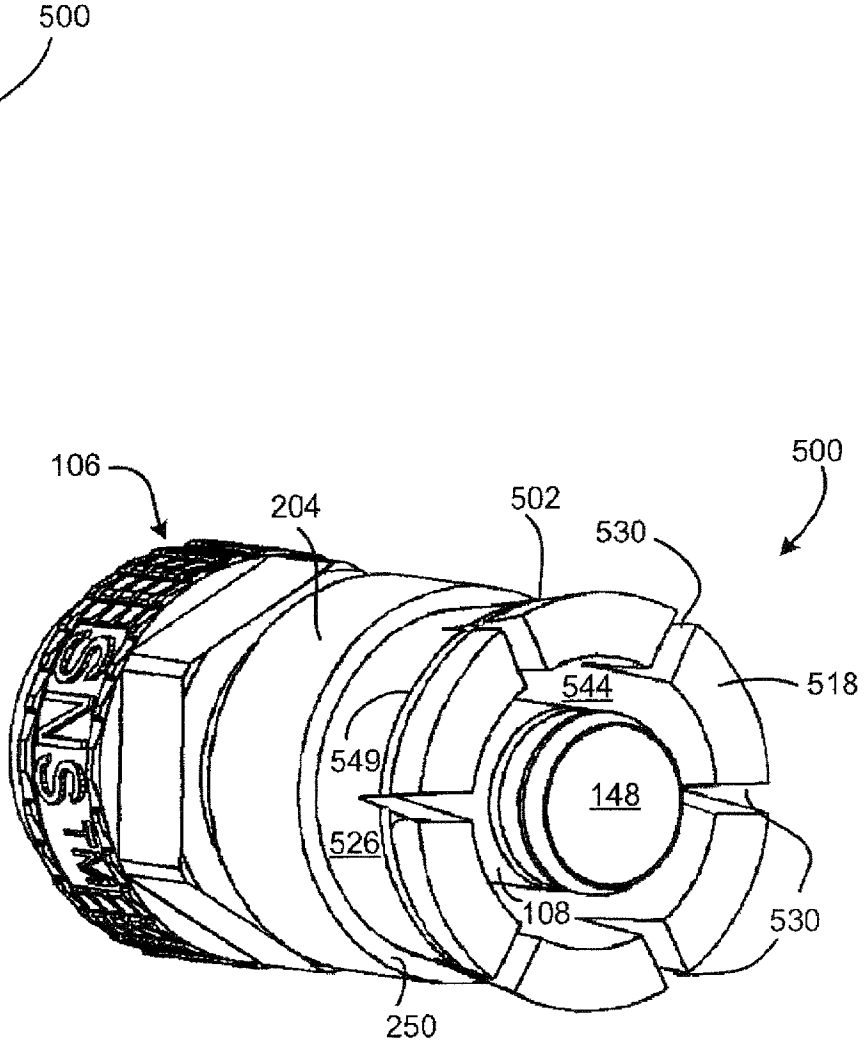
FIGS. 5B and 5C are isometric views of the coaxial cable connector of FIG. 5A.
Figure 5B:
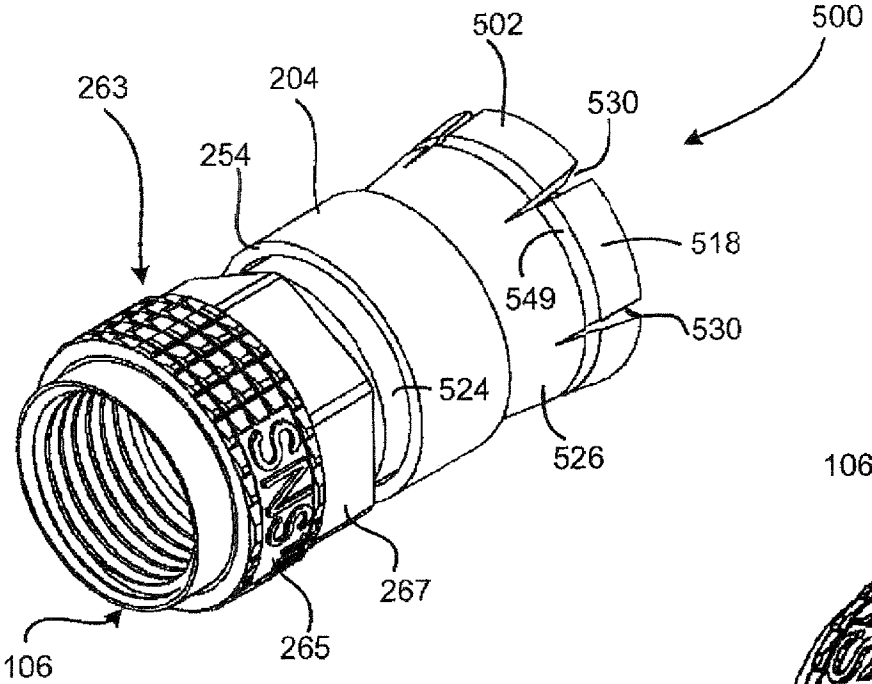

Referring now to FIGS. 5A-5C, yet another alternative implementation of a connector 500 is illustrated. The embodiment of FIGS. 5A-5C is similar to the embodiments described above and similar reference numbers are used where appropriate. In the embodiment of FIGS. 5A-5C, connector 500 may include connector body 502, sliding ring 204, nut 106, post 108, and O-ring 110.

Connector body 502, similar to connector body 102 of FIGS. 1A-1D, may include an elongated, cylindrical member, formed of a resilient, compressible, or deformable material, such as a soft plastic or semi-rigid rubber material. Connector body 502 may include (1) outer surface 512, (2) inner surface 514, (3) forward end 516 coupled to annular post 108 and rotatable nut 106, and (4) cable receiving end 518, opposite forward end 516.

In one implementation, forward end 516 of connector body 502 may include a stepped configuration to receive a rearward end of nut 106 thereon. More specifically, as shown in FIG. 5A, forward end 516 of connector body 502 may include a first cylindrical portion 520, a second cylindrical portion 522 having a diameter larger than first cylindrical portion 520, a third cylindrical portion 524 having a diameter larger than second cylindrical portion 522, and a flared or ramped end portion 526 extending from third cylindrical portion 522 to cable receiving end 518 of connector body 502. As shown, an initial outside diameter of flared end portion 526 may be substantially equal to the outside diameter of third cylindrical portion 522. In one embodiment, a peak outside diameter of flared end portion 526 (e.g., proximal to cable receiving end 518) may be approximately 0.09 inches larger than the outside diameter of third cylindrical portion 522. In other instances, the angle of flared end portion 526 may be approximately 6-10 degrees (e.g., 8 degrees) with respect to the longitudinal axis of connector 500.

As shown in FIG. 5A, third cylindrical portion 524 of body 502 may include a first annular groove 528 Annular groove 528 may mate with a corresponding annular protrusion 252 in sliding ring 204 to maintain sliding ring 204 in the first (e.g., non-compressed) position prior to compression of connector 500.

In addition, flared end portion 526 may include a plurality of axial slots or cuts 530 formed therein, as best shown in FIGS. 5B and 5C. In one exemplary embodiment, each of axial slots 530 may extend through flared end portion 526 in a substantially V-shaped manner in which the apex of the "V" is axial in relation to the open side of each slot 530. Exemplary slots 530 may have a width of approximately 0.025 to 0.045 inches at the open end thereof. Similar to slots 330 described above in FIGS. 3A-4, slots 530 may allow flared end portion 526 to collapse or compress in on itself in a uniform manner when sliding ring 204 is moved from the uncompressed position (shown in FIGS. 5A-5C) to the compressed position (not shown).

In one exemplary implementation, slots 530 may extend from an interface of flared end portion 526 with third cylindrical portion 524 to an end of flared end portion 526. In one implementation, connector body 502 may include six slots 530, however any suitable number of slots 530 may be provided.

Inner surface 514 of connector body 502 may include a first tubular portion 532, a second tubular portion 534, and a third tubular portion 536. Tubular portions 532-536 may be concentrically formed within connector body 502 such that post 108 may be received therein during assembly of connector 500. As shown in FIG. 5A, first tubular portion 532 may be formed at forward end 516 of connector body 502 and may have an inside diameter approximately equal to an outside diameter of a body engagement portion 138 of post 108. Second tubular portion 534 may have an inside diameter larger than the inside diameter of first tubular portion 532 and may form an annular notch 540 with respect to first tubular portion 532 Annular notch 540 may be configured to receive a body engagement barb 142 formed in post 108.

Third tubular portion 536 may have an inside diameter larger than the inside diameter of second tubular portion 534 and may form a cavity 544 for receiving a tubular extension 162 of post 108. Furthermore, as described below, post 108 may include a tubular cavity 148 therein. During connection of connector 500 to a coaxial cable, tubular cavity 148 may receive a center conductor and dielectric covering of the inserted coaxial cable and forward cavity 544 may receive a jacket and shield of the inserted cable.

Flared end portion 526 of body 502 may include a second annular groove 549 formed in an intermediate exterior portion thereof. Second annular groove 549 may mate with corresponding annular protrusion 252 in sliding ring 204 to maintain sliding ring 204 in the second (e.g., compressed) position following compression of connector 500.

Sliding ring 204 in FIGS. 5A-5C may be substantially similar to sliding ring 204 described above with respect to FIGS. 2A-2C. That is, sliding ring 204 may include tubular body having rearward end 250, an inner annular protrusion 252, and forward end 254. As shown in FIG. 5A, sliding ring 204 may have an inside diameter approximately equal to an outside diameter of third cylindrical portion 524 Inner annular protrusion 252 may project from the inside of sliding ring 204 and may have an inside diameter approximately equal to an outside diameter of first annular groove 528, such that undesired rearward movement of sliding ring 204 relative to connector body 502 is minimized or limited.

As described above, post 108 may be configured for receipt within body 502 during assembly of connector 500 and may include flanged base portion 156, body engagement portion 138 having a body engagement barb 142, and tubular extension 162 projecting rearwardly from body engagement portion 138. Flanged base portion 156, body engagement portion 138 and tubular extension 162 together define inner chamber 148 for receiving a center conductor and insulator of an inserted coaxial cable. As shown in FIG. 5A, in one implementation, the rearward end of tubular extension 162 may include barb 164 to enhance compression of the outer jacket of the coaxial cable and to secure the cable within connector 500.

Tubular extension 162 of post 108, and third tubular portion 536 of connector body 502 together define annular cavity 544 for accommodating the jacket and shield of an inserted coaxial cable. In exemplary implementations, the distance between the outside diameter of tubular extension 162 and the diameter of third tubular portion 536 is between about 0.0585 to 0.0665 inches. This may also be referred to as the installation opening of connector 500.

In one implementation, as shown in FIG. 5A, following assembly of post 108 into connector body 502, a rearward end of tubular extension 162 may extend beyond an end of cable receiving end 518 of connector body 502. For example, tubular extension 162 may extend approximately 0.030 inches beyond an end of cable receiving end 518. In other implementations, an end of tubular extension 162 may be substantially even or flush with respect to an end of cable receiving end 518 of connector body 502.

Similar to annular nut 106 described above in relation to FIGS. 1A-1D and FIGS. 2A-2C, annular nut 106 in FIGS. 5A-5C may be rotatably coupled to forward end 516 of connector body 502. Annular nut 106 may include any number of attaching mechanisms, such as that of a hex nut, a knurled nut, a wing nut, or any other known attaching means, and may be rotatably coupled to connector body 502 for providing mechanical attachment of connector 500 to an external device, e.g., port connector 180, via a threaded relationship. As illustrated in FIG. 5B, in an exemplary implementation, annular nut 106 may include a two-part user engagement portion 263 that includes a hand turning portion 265, and a tool turning portion 267 for engaging a tool, such as a socket or wrench.

Connector 500 may be supplied in an assembled condition, as shown in FIG. 5A, in which sliding ring 204 is installed on connector body 502 in a forward (e.g., uncompressed) position. A prepared end of a coaxial cable may be received through cable receiving end 518 of body 502 to engage post 108 of connector 200, as described above. Once the prepared end of the coaxial cable is inserted into connector body 502 so that the cable jacket is separated from the insulator by the sharp edge of post 108, sliding ring 204 may be moved axially rearward in direction A from the first position (shown in FIG. 5A) to a second position (not shown). In some embodiments, a compression tool may be used to advance sliding ring 204 from the first position to the second position.

As sliding ring 204 moves axially rearward in direction A, curved rearward end 250 of sliding ring 204 may engage the outer surface of flared end portion 526, thereby forcing flared end portion 526 radially inward toward post 108. Slots 530 in the outer surface of flared end portion 526 may facilitate the radial compression of flared end portion 526 by providing a number of collapsing regions on an outer surfaced of flared end portion 526.

Upon continued rearward movement of sliding ring 204, annular protrusion 252 in sliding ring 204 may engage second annular groove 549 in flared end 526 (i.e. combining to form a retainer) to maintain sliding ring 204 in the second (e.g., compressed) position. In other implementations, a friction relationship between flared end portion 526 and sliding ring 204 may be sufficient to maintain sliding ring 204 in the second position following securing of a coaxial cable to connector 500.

Figure 6A:
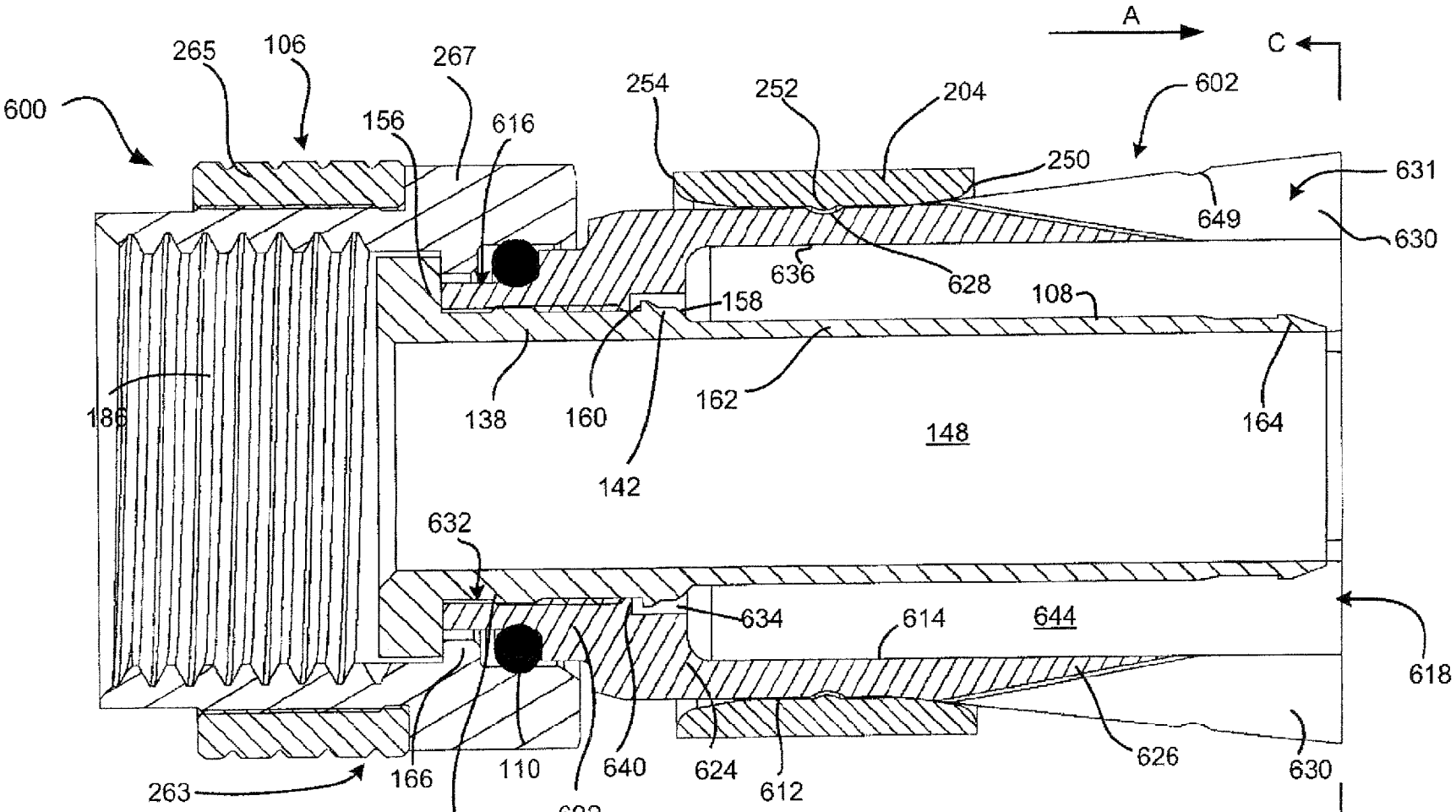
FIG. 6A is a cross-sectional view of yet another exemplary coaxial cable connector in an uncompressed configuration.
Figure 6B:
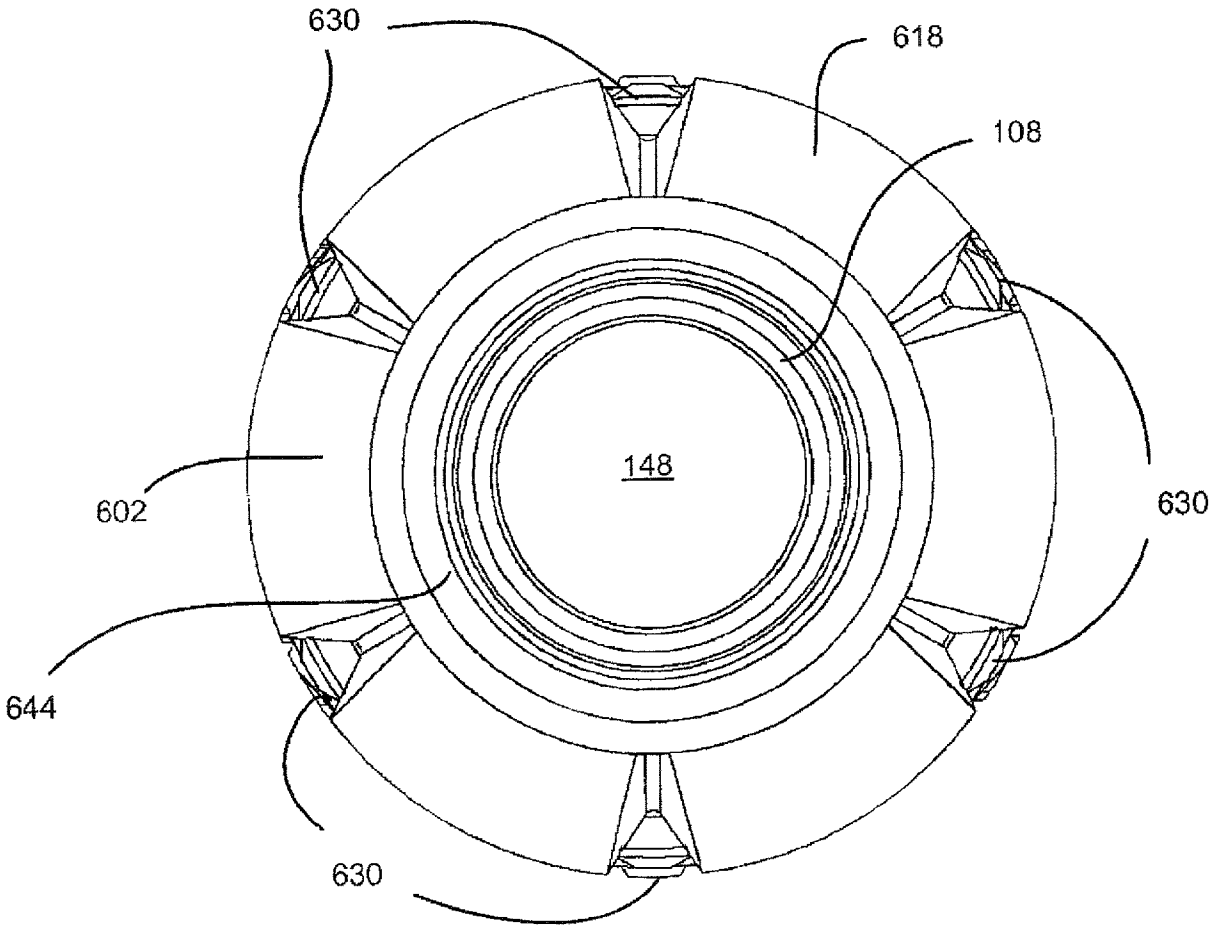
FIG. 6B is an end view of the coaxial cable connector of FIG. 6A taken along the line C-C in FIG. 6A.

Referring now to FIGS. 6A and 6B, yet another alternative implementation of a connector 600 is illustrated. The embodiment of FIGS. 6A and 6B is similar to the embodiments described above and similar reference numbers are used where appropriate. In the embodiment of FIGS. 6A and 6B, connector 600 may include connector body 602, sliding ring 204, nut 106, post 108, and O-ring 110.

Connector body 602, similar to connector body 102 of FIGS. 1A-1D, may include an elongated, cylindrical member, formed of a resilient, compressible, or deformable material, such as a soft plastic or semi-rigid rubber material. Connector body 602 may include (1) outer surface 612, (2) inner surface 614, (3) forward end 616 coupled to annular post 108 and rotatable nut 106, and (4) cable receiving end 618, opposite forward end 616.

In one implementation, forward end 616 of connector body 602 may include a stepped configuration to receive a rearward end of nut 106 thereon. More specifically, as shown in FIG. 6A, forward end 616 of connector body 602 may include a first cylindrical portion 620, a second cylindrical portion 622 having a diameter larger than first cylindrical portion 620, a third cylindrical portion 624 having a diameter larger than second cylindrical portion 622, and a flared or ramped end portion 626 extending from third cylindrical portion 622 to cable receiving end 618 of connector body 602.

As shown, an initial outside diameter of flared end portion 626 may be substantially equal to the outside diameter of third cylindrical portion 622. In one embodiment, a peak outside diameter of flared end portion 626 (e.g., proximal to cable receiving end 618) may be approximately 0.09 inches larger than the outside diameter of third cylindrical portion 622. In other instances, the angle of flared end portion 626 may be approximately 6-10 degrees (e.g., 8 degrees) with respect to the longitudinal axis of connector 600.

As shown in FIG. 6A, third cylindrical portion 624 of body 602 may include a first annular groove 628. Annular groove 628 may mate with a corresponding annular protrusion 252 in sliding ring 204 to maintain sliding ring 204 in the first (e.g., non-compressed) position prior to compression of connector 600.

Flared end portion 626 of body 602 may include a second annular groove 649 formed in an intermediate exterior portion thereof. Second annular groove 649 may mate with corresponding annular protrusion 252 in sliding ring 204 to maintain sliding ring 204 in the second (e.g., compressed) position following compression of connector 600.

In addition, flared end portion 626 may include a plurality of axial notches 630 formed therein. In one exemplary embodiment, as shown in FIG. 6B, each of axial notches 630 may be substantially V-shaped and may be formed in a spaced relationship along an outer surface of flared end portion 626. Notches 630 may extend from an interface of flared end portion 626 with third cylindrical portion 624 to an end of flared end portion 626. In one implementation, connector body 602 may include six notches 630, however any suitable number of notches 630 may be provided.

In addition, as shown in FIG. 6A, each of notches 630 may be angled with respect to the longitudinal axis of connector body 602, such that a rearwardmost portion 631 of each notch 630 extends completely through flared end portion 626.

Exemplary slots 630 may have an outside width of approximately 0.075 to 0.040 inches, an inside width of approximately 0.030 to 0.020 inches (at an inside diameter of flared end portion 626), and an axial angle of approximately 15 to 35 degrees. Similar to notches 230 described above in FIGS. 2A-2C, slots 630 may allow flared end portion 626 to collapse or compress in on itself in a uniform manner when sliding ring 204 is moved from the uncompressed position (shown in FIGS. 6A and 6B) to the compressed position (not shown).

Inner surface 614 of connector body 602 may include a first tubular portion 632, a second tubular portion 634, and a third tubular portion 636. Tubular portions 632-636 may be concentrically formed within connector body 602 such that post 108 may be received therein during assembly of connector 600. As shown in FIG. 6A, first tubular portion 632 may be formed at forward end 616 of connector body 602 and may have an inside diameter approximately equal to an outside diameter of a body engagement portion 138 of post 108. Second tubular portion 634 may have an inside diameter larger than the inside diameter of first tubular portion 632 and may form an annular notch 640 with respect to first tubular portion 632. Annular notch 640 may be configured to receive a body engagement barb 142 formed in post 108.

Third tubular portion 636 may have an inside diameter larger than the inside diameter of second tubular portion 634 and may form a cavity 644 for receiving a tubular extension 162 of post 108. Furthermore, as described below, post 108 may include a tubular cavity 148 therein. During connection of connector 600 to a coaxial cable, tubular cavity 148 may receive a center conductor and dielectric covering of the inserted coaxial cable and forward cavity 644 may receive a jacket and shield of the inserted cable.

Sliding ring 204 in FIGS. 6A and 6B may be substantially similar to sliding ring 204 described above with respect to FIGS. 2A-2C. That is, sliding ring 204 may include tubular body having rearward end 250, an inner annular protrusion 252, and forward end 254. As shown in FIG. 6A, sliding ring 204 may have an inside diameter approximately equal to an outside diameter of third cylindrical portion 624 Inner annular protrusion 252 may project from the inside of sliding ring 204 and may have an inside diameter approximately equal to an outside diameter of first annular groove 628, such that undesired rearward movement of sliding ring 204 relative to connector body 602 is minimized or limited.

As described above, post 108 may be configured for receipt within body 602 during assembly of connector 600 and may include flanged base portion 156, body engagement portion 138 having a body engagement barb 142, and tubular extension 162 projecting rearwardly from body engagement portion 138. Flanged base portion 156, body engagement portion 138 and tubular extension 162 together define inner chamber 148 for receiving a center conductor and insulator of an inserted coaxial cable. As shown in FIG. 6A, in one implementation, the rearward end of tubular extension 162 may include barb 164 to enhance compression of the outer jacket of the coaxial cable and to secure the cable within connector 600.

Tubular extension 162 of post 108, and third tubular portion 636 of connector body 602 together define annular cavity 644 for accommodating the jacket and shield of an inserted coaxial cable. In exemplary implementations, the distance between the outside diameter of tubular extension 162 and the diameter of third tubular portion 636 is between about 0.0585 to 0.0665 inches. This may also be referred to as the installation opening of connector 600.

In one implementation, as shown in FIG. 6A, following assembly of post 108 into connector body 602, a rearward end of tubular extension 162 may extend beyond an end of cable receiving end 618 of connector body 602. For example, tubular extension 162 may extend approximately 0.030 beyond an end of cable receiving end 618. In other implementations, an end of tubular extension 162 may be substantially even or flush with respect to an end of cable receiving end 618 of connector body 602.

Similar to annular nut 106 described above in relation to FIGS. 1A-1D and FIGS. 2A-2C, annular nut 106 in FIGS. 6A and 6B may be rotatably coupled to forward end 616 of connector body 602. Annular nut 106 may include any number of attaching mechanisms, such as that of a hex nut, a knurled nut, a wing nut, or any other known attaching means, and may be rotatably coupled to connector body 602 for providing mechanical attachment of connector 600 to an external device, e.g., port connector 180, via a threaded relationship. As illustrated in FIG. 6A, in an exemplary implementation, annular nut 106 may include a two-part user engagement portion 263 that includes a hand turning portion 265, and a tool turning portion 267 for engaging a tool, such as a socket or wrench.

Connector 600 may be supplied in an assembled condition, as shown in FIG. 6A, in which sliding ring 204 is installed on connector body 602 in a forward (e.g., uncompressed) position. A prepared end of a coaxial cable may be received through cable receiving end 618 of body 602 to engage post 108 of connector 600, as described above. Once the prepared end of the coaxial cable is inserted into connector body 602 so that the cable jacket is separated from the insulator by the sharp edge of post 108, sliding ring 204 may be moved axially rearward in direction A from the first position (shown in FIG. 6A) to a second position (not shown). In some embodiments, a compression tool may be used to advance sliding ring 204 from the first position to the second position.

As sliding ring 204 moves axially rearward in direction A, curved rearward end 250 of sliding ring 204 may engage the outer surface of flared end portion 626, thereby forcing flared end portion 626 radially inward toward post 108. Slots 630 in the outer surface of flared end portion 626 may facilitate the radial compression of flared end portion 626 by providing a number of collapsing regions on an outer surfaced of flared end portion 626.

Upon continued rearward movement of sliding ring 204, annular protrusion 252 in sliding ring 204 may engage second annular groove 649 in flared end 626 (i.e., combining to form a retainer) to maintain sliding ring 204 in the second (e.g., compressed) position. In other implementations, a friction relationship between flared end portion 626 and sliding ring 204 may be sufficient to maintain sliding ring 204 in the second position following securing of a coaxial cable to connector 600.

Figure 7A:
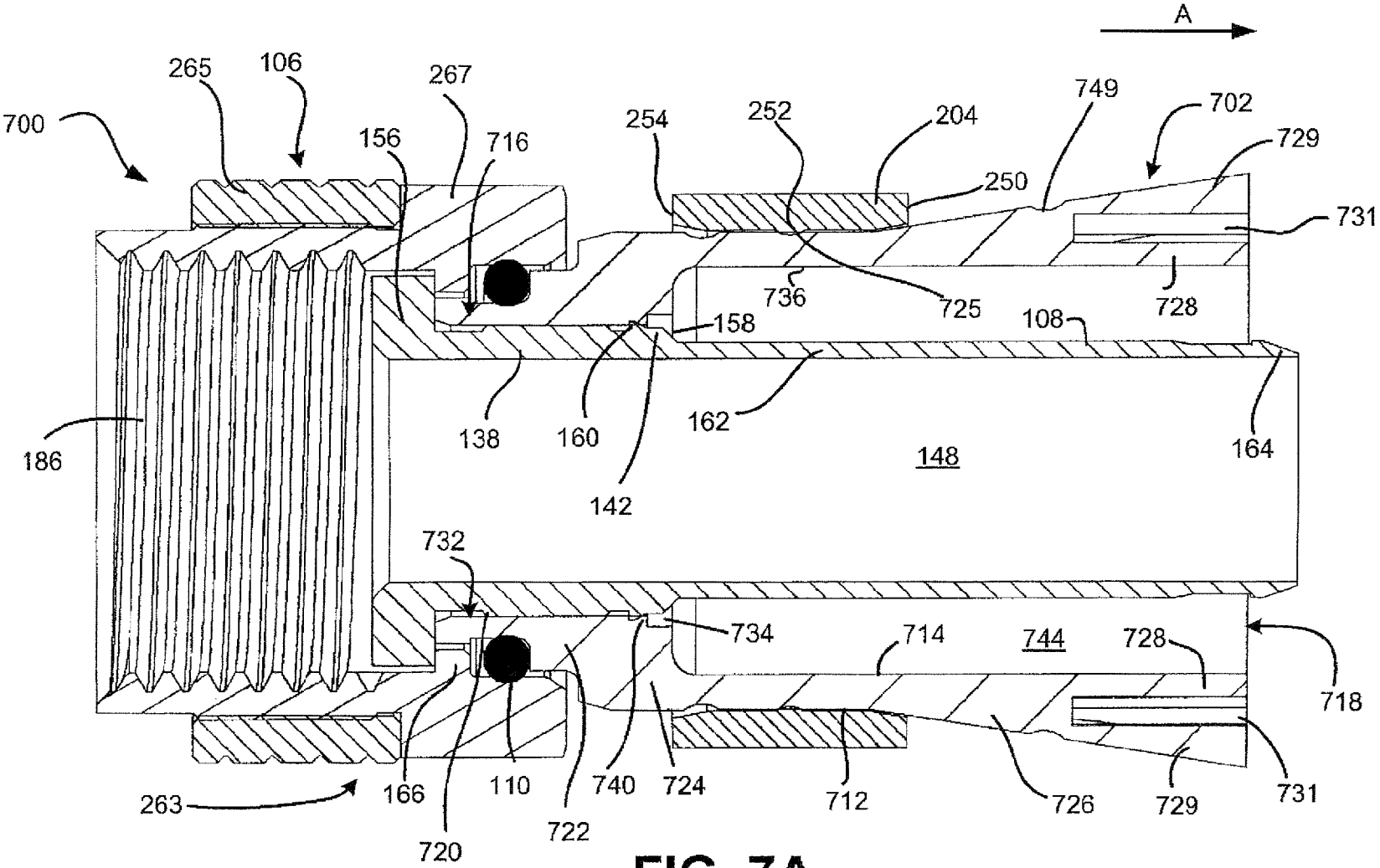
FIG. 7A is a cross-sectional view of still another exemplary coaxial cable connector in an uncompressed configuration.
Figure 7C:
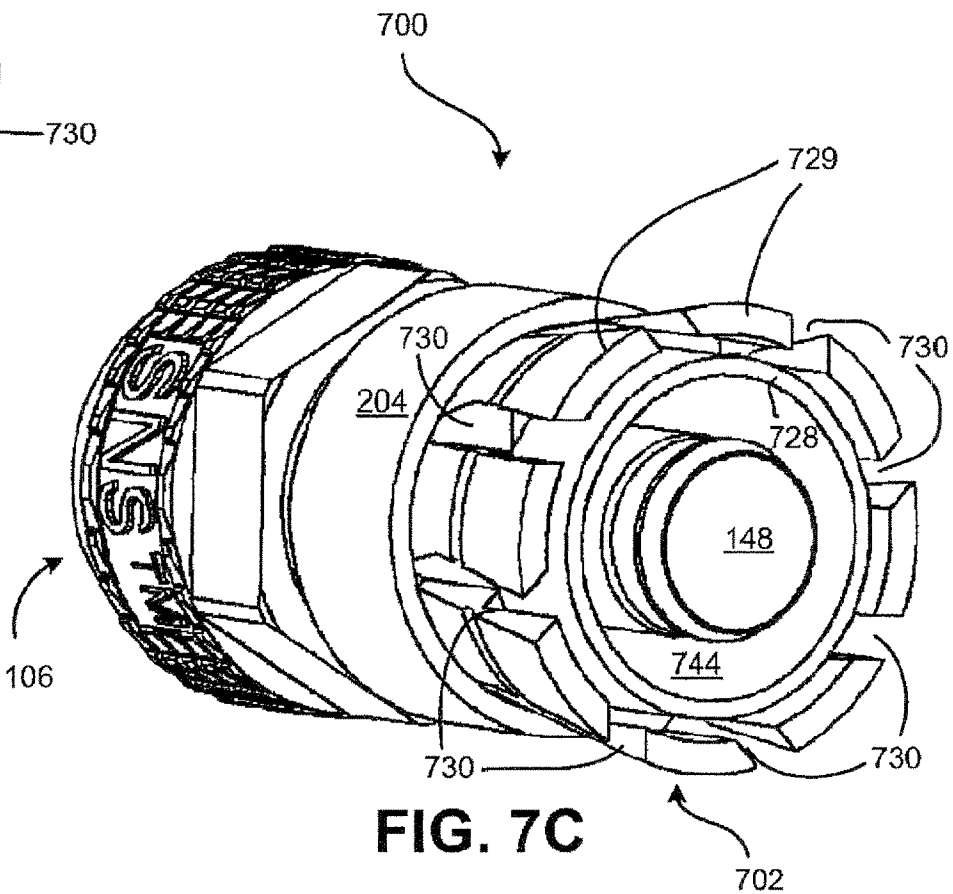
FIGS. 7B and 7C are isometric views of the coaxial cable connector of FIG. 7A.
Figure 7B:
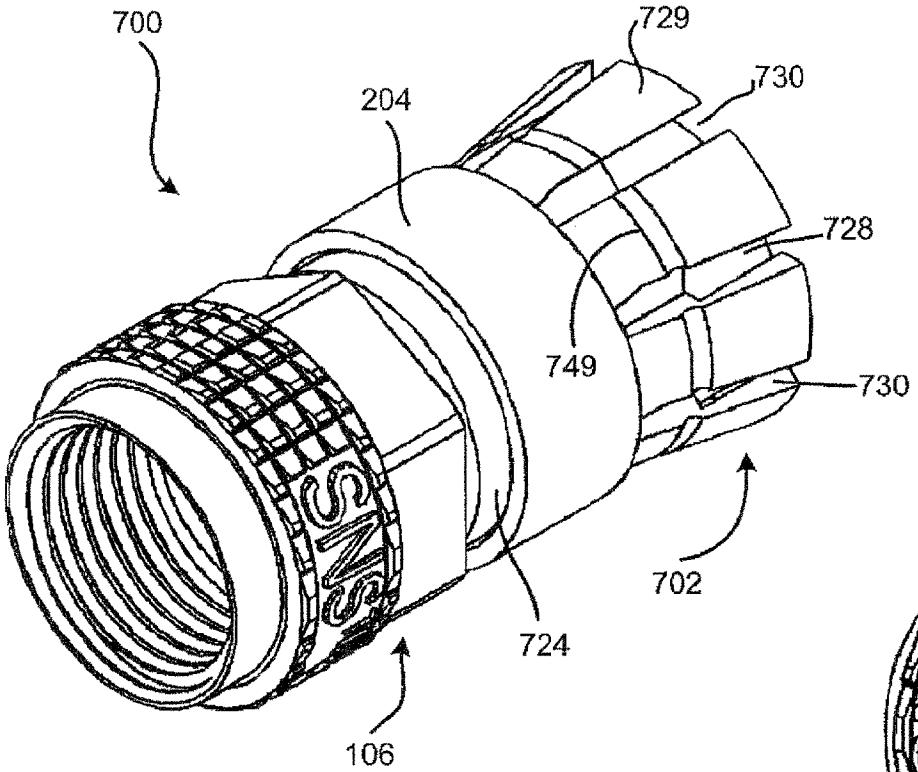

Referring now to FIGS. 7A-7C, yet another alternative implementation of a connector 700 is illustrated. The embodiment of FIGS. 7A-7C is similar to the embodiments described above and similar reference numbers are used where appropriate. In the embodiment of FIGS. 7A-7C, connector 700 may include connector body 702, sliding ring 204, nut 106, post 108, and O-ring 110.

Connector body 702, similar to connector body 102 of FIGS. 1A-1D, may include an elongated, cylindrical member, formed of a resilient, compressible, or deformable material, such as a soft plastic or semi-rigid rubber material. Connector body 702 may include (1) outer surface 712, (2) inner surface 714, (3) forward end 716 coupled to annular post 108 and rotatable nut 106, and (4) cable receiving end 718, opposite forward end 716.

In one implementation, forward end 716 of connector body 702 may include a stepped configuration to receive a rearward end of nut 106 thereon. More specifically, as shown in FIG. 7A, forward end 716 of connector body 702 may include a first cylindrical portion 720, a second cylindrical portion 722 having a diameter larger than first cylindrical portion 720, a third cylindrical portion 724 having a diameter larger than second cylindrical portion 722, and a flared or ramped end portion 726 extending from third cylindrical portion 722 to cable receiving end 718 of connector body 702. As shown, an initial outside diameter of flared end portion 726 may be substantially equal to the outside diameter of third cylindrical portion 722. In one embodiment, a peak outside diameter of flared end portion 726 (e.g., proximal to cable receiving end 718) may be approximately 0.09 inches larger than the outside diameter of third cylindrical portion 722. In other instances, the angle of flared end portion 726 may be approximately 6-10 degrees (e.g., 8 degrees) with respect to the longitudinal axis of connector 700.

As shown in FIG. 7A, third cylindrical portion 724 of body 702 may include a first annular groove 725. Annular groove 725 may mate with a corresponding annular protrusion 252 in sliding ring 204 to maintain sliding ring 204 in the first (e.g., non-compressed) position prior to compression of connector 700.

In addition, flared end portion 726 may include a seal region 728 and a compression region 729. As shown in FIGS. 7A and 7C, seal region 728 may be formed by the formation of an axial slot or channel 731 in an end of flared end portion 726. In one implementation, channel 731 may be substantially cylindrical and may have a width ranging from approximately 0.015 inches to approximately 0.040 inches. The formation of channel 731 causes seal region 728 to remain in an inner region of flared end portion 726. In one implementation, seal region 728 may be substantially cylindrical and may have a width ranging from approximately 0.015 to approximately 0.025 inches.

Compression region 729 may be formed in a portion of flared end portion 726 outside of channel 731. As shown best in FIG. 7C, compression region 729 may include a plurality of axial slots or cuts 730 formed therein. In one exemplary embodiment, each of axial slots 730 may extend through compression region 729 and may allow flared end portion 726 to collapse or compress in on itself In a uniform manner when sliding ring 204 is moved from the uncompressed position (shown in FIGS. 7A-7C) to the compressed position (not shown).

In one exemplary implementation, slots 730 may extend from an interface of flared end portion 726 with third cylindrical portion 724 to an end of flared end portion 726. In one implementation, connector body 702 may include six slots 730, however any suitable number of slots 730 may be provided.

Inner surface 714 of connector body 702 may include a first tubular portion 732, a second tubular portion 734, and a third tubular portion 736. Tubular portions 732-736 may be concentrically formed within connector body 702 such that post 108 may be received therein during assembly of connector 700. As shown in FIG. 7A, first tubular portion 732 may be formed at forward end 716 of connector body 702 and may have an inside diameter approximately equal to an outside diameter of a body engagement portion 138 of post 108. Second tubular portion 734 may have an inside diameter larger than the inside diameter of first tubular portion 732 and may form an annular notch 740 with respect to first tubular portion 732. Annular notch 740 may be configured to receive a body engagement barb 142 formed in post 108.

Third tubular portion 736 may have an inside diameter larger than the inside diameter of second tubular portion 734 and may form a cavity 744 for receiving a tubular extension 162 of post 108. As described above, a portion of third tubular portion 736 may form the inside surface of seal region 728.

Post 108 may include a tubular cavity 148 therein. During connection of connector 700 to a coaxial cable, tubular cavity 148 may receive a center conductor and dielectric covering of the inserted coaxial cable and forward cavity 744 may receive a jacket and shield of the inserted cable.

Flared end portion 726 of body 702 may include a second annular groove 749 formed in an intermediate exterior portion thereof. Second annular groove 749 may mate with corresponding annular protrusion 252 in sliding ring 204 to maintain sliding ring 204 in the second (e.g., compressed) position following compression of connector 700.

Sliding ring 204 in FIGS. 7A-7C may be substantially similar to sliding ring 204 described above with respect to FIGS. 2A-2C. That is, sliding ring 204 may include tubular body having rearward end 250, an inner annular protrusion 252, and forward end 254. As shown in FIG. 7A, sliding ring 204 may have an inside diameter approximately equal to an outside diameter of third cylindrical portion 724 Inner annular protrusion 252 may project from the inside of sliding ring 204 and may have an inside diameter approximately equal to an outside diameter of first annular groove 725, such that undesired rearward movement of sliding ring 204 relative to connector body 702 is minimized or limited.

As described above, post 108 may be configured for receipt within body 702 during assembly of connector 700 and may include flanged base portion 156, body engagement portion 138 having a body engagement barb 142, and tubular extension 162 projecting rearwardly from body engagement portion 138. Flanged base portion 156, body engagement portion 138 and tubular extension 162 together define inner chamber 148 for receiving a center conductor and insulator of an inserted coaxial cable. As shown in FIG. 7A, in one implementation, the rearward end of tubular extension 162 may include barb 164 to enhance compression of the outer jacket of the coaxial cable and to secure the cable within connector 700.

Tubular extension 162 of post 108, and third tubular portion 736 of connector body 702 together define annular cavity 744 for accommodating the jacket and shield of an inserted coaxial cable. In exemplary implementations, the distance between the outside diameter of tubular extension 162 and the diameter of third tubular portion 736 is between about 0.0585 to 0.0665 inches. This may also be referred to as the installation opening of connector 700.

In one implementation, as shown in FIG. 7A, following assembly of post 108 into connector body 702, a rearward end of tubular extension 162 may extend beyond an end of cable receiving end 718 of connector body 702. For example, tubular extension 162 may extend approximately 0.030 beyond an end of cable receiving end 718. In other implementations, an end of tubular extension 162 may be substantially even or flush with respect to an end of cable receiving end 718 of connector body 702.

Similar to annular nut 106 described above in relation to FIGS. 1A-1D and FIGS. 2A-2C, annular nut 106 in FIGS. 7A-7C may be rotatably coupled to forward end 716 of connector body 702. Annular nut 106 may include any number of attaching mechanisms, such as that of a hex nut, a knurled nut, a wing nut, or any other known attaching means, and may be rotatably coupled to connector body 702 for providing mechanical attachment of connector 700 to an external device, e.g., port connector 180, via a threaded relationship. As illustrated in FIG. 7A, in an exemplary implementation, annular nut 106 may include a two-part user engagement portion 263 that includes a hand turning portion 265, and a tool turning portion 267 for engaging a tool, such as a socket or wrench.

Connector 700 may be supplied in an assembled condition, as shown in FIGS. 7A-7C, in which sliding ring 204 is installed on connector body 702 in a forward (e.g., uncompressed) position. A prepared end of a coaxial cable may be received through cable receiving end 718 of body 702 to engage post 108 of connector 700, as described above. Once the prepared end of the coaxial cable is inserted into connector body 702 so that the cable jacket is separated from the insulator by the sharp edge of post 108, sliding ring 204 may be moved axially rearward in direction A from the first position (shown in FIG. 7A) to a second position (not shown). In some embodiments, a compression tool may be used to advance sliding ring 204 from the first position to the second position.

As sliding ring 204 moves axially rearward in direction A, curved rearward end 250 of sliding ring 204 may engage the outer surface of flared end portion 726, thereby forcing flared end portion 726 radially inward toward post 108. Slots 730 in compression region 729 may facilitate the radial compression of flared end portion 726 by providing a number of collapsing regions on an outer surfaced of flared end portion 726.

Seal region 728 may be radially compressed toward post 108 upon continued rearward movement of sliding ring 204. Channel 731 in flared end portion 726 may cause seal region to compress uniformly toward post 108, thereby providing a watertight seal between connector body 702 and the cable jacket of the inserted cable end.

Upon continued rearward movement of sliding ring 204, annular protrusion 252 in sliding ring 204 may engage second annular groove 749 in flared end portion 726 (i.e., combining to form a retainer) to maintain sliding ring 204 in the second (e.g., compressed) position. In other implementations, a friction relationship between flared end portion 726 and sliding ring 204 may be sufficient to maintain sliding ring 204 in the second position following securing of a coaxial cable to connector 700.

Figure 8A:
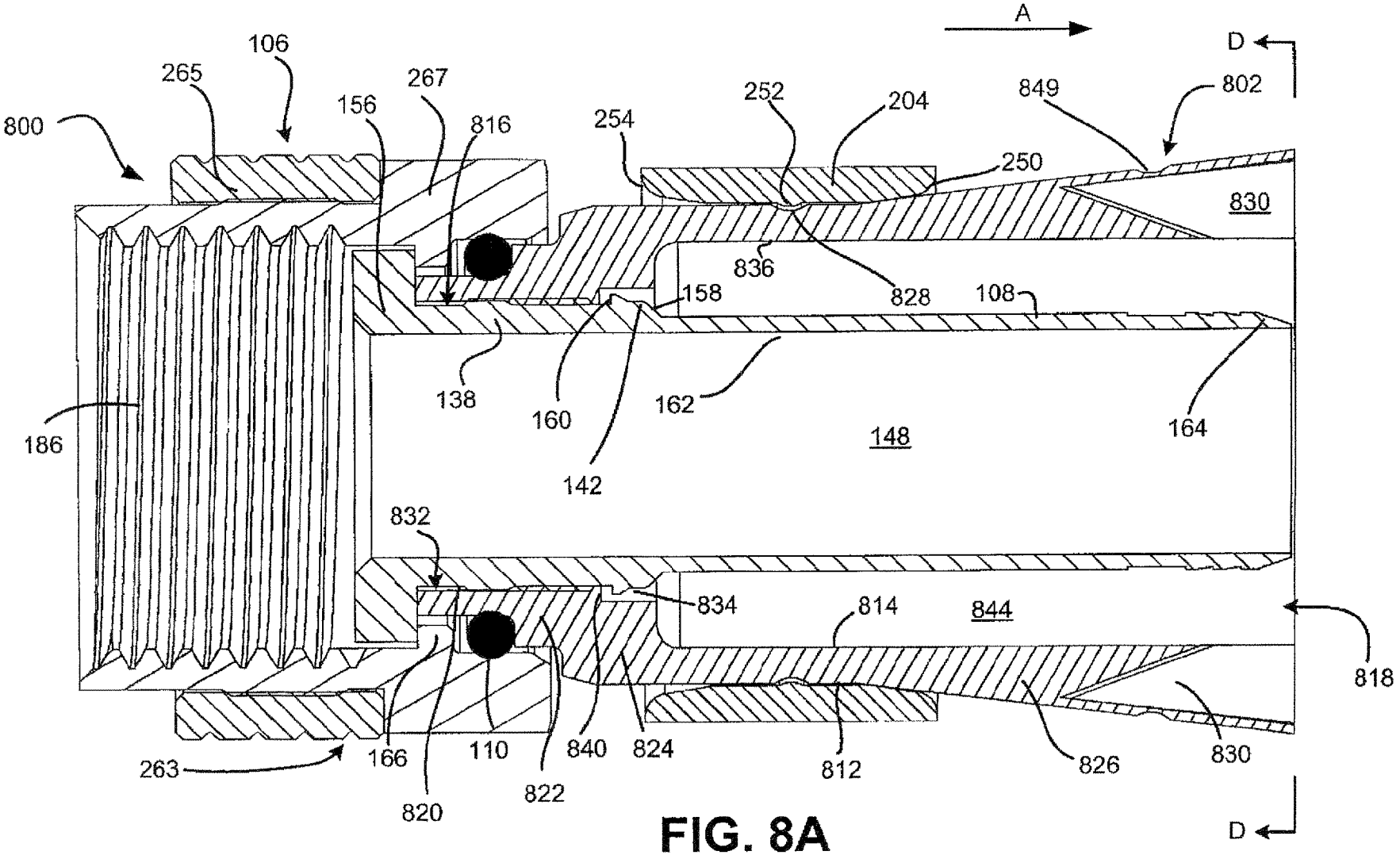
FIG. 8A is a cross-sectional view of another exemplary coaxial cable connector in an uncompressed configuration.
Figure 8B:
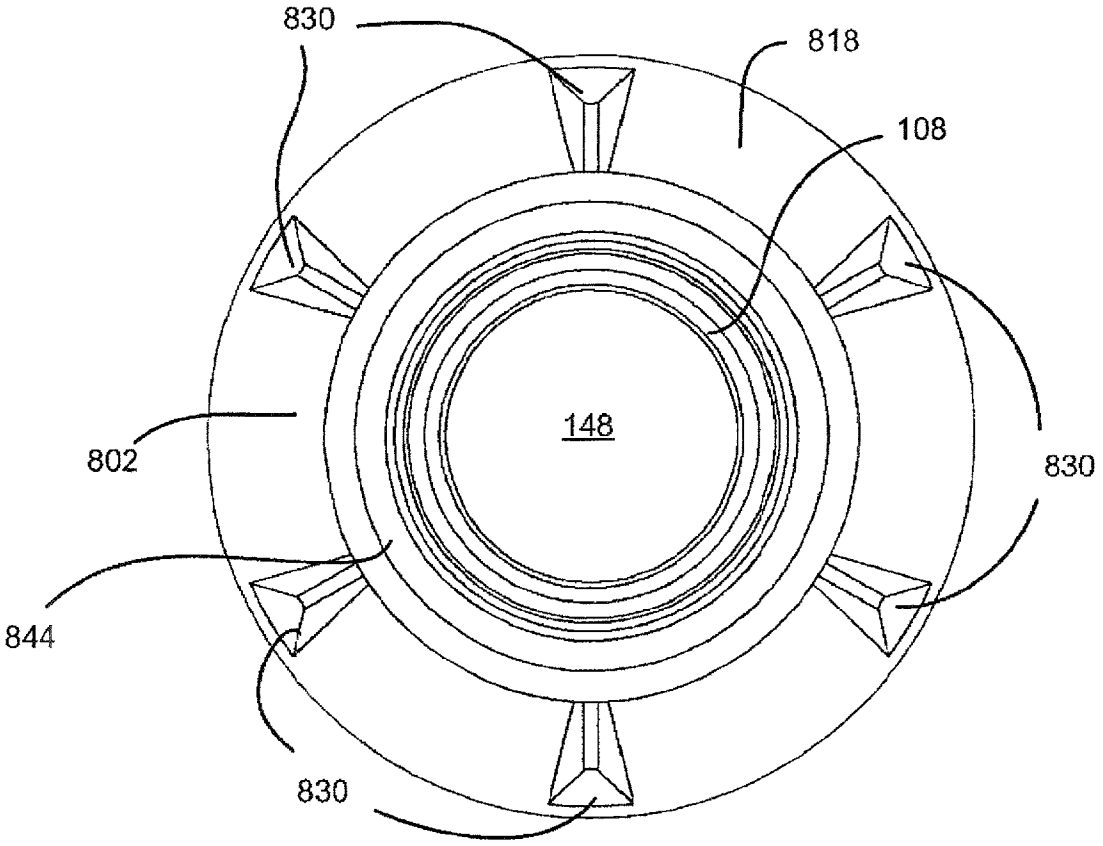
FIG. 8B is an end view of the coaxial cable connector of FIG. 8A taken along the line D-D in FIG. 8A.

Referring now to FIGS. 8A and 8B, yet another alternative implementation of a connector 800 is illustrated. The embodiment of FIGS. 8A and 8B is similar to the embodiments described above and similar reference numbers are used where appropriate. In the embodiment of FIGS. 8A and 8B, connector 800 may include connector body 802, sliding ring 204, nut 106, post 108, and O-ring 110.

Connector body 802, similar to connector body 602 of FIGS. 6A and 6B, may include an elongated, cylindrical member, formed of a resilient, compressible, or deformable material, such as a soft plastic or semi-rigid rubber material. Connector body 802 may include (1) outer surface 812, (2) inner surface 814, (3) forward end 816 coupled to annular post 108 and rotatable nut 106, and (4) cable receiving end 818, opposite forward end 816.

In one implementation, forward end 816 of connector body 802 may include a stepped configuration to receive a rearward end of nut 106 thereon. More specifically, as shown in FIG. 8A, forward end 816 of connector body 802 may include a first cylindrical portion 820, a second cylindrical portion 822 having a diameter larger than first cylindrical portion 820, a third cylindrical portion 824 having a diameter larger than second cylindrical portion 822, and a flared or ramped end portion 826 extending from third cylindrical portion 822 to cable receiving end 818 of connector body 802.

As shown, an initial outside diameter of flared end portion 826 may be substantially equal to the outside diameter of third cylindrical portion 822. In one embodiment, a peak outside diameter of flared end portion 826 (e.g., proximal to cable receiving end 818) may be approximately 0.09 inches larger than the outside diameter of third cylindrical portion 822. In other instances, the angle of flared end portion 826 may be approximately 6-10 degrees (e.g., 8 degrees) with respect to the longitudinal axis of connector 800.

As shown in FIG. 8A, third cylindrical portion 824 of body 802 may include a first annular groove 828. Annular groove 828 may mate with a corresponding annular protrusion 252 in sliding ring 204 to maintain sliding ring 204 in the first (e.g., non-compressed) position prior to compression of connector 800.

Flared end portion 826 of body 802 may include a second annular groove 849 formed in an intermediate exterior portion thereof. Second annular groove 849 may mate with corresponding annular protrusion 252 in sliding ring 204 to maintain sliding ring 204 in the second (e.g., compressed) position following compression of connector 800.

In addition, flared end portion 826 may include a plurality of interior axial notches 830 formed therein. In one exemplary embodiment, as shown in FIG. 8B, each of interior axial notches 830 may be substantially V-shaped and may be formed in a radial spaced relationship in an interior portion of flared end portion 826. That is, an exterior surface of flared end portion 826 may be uniform throughout its exterior, and notches 830 may be formed in an interior surface thereof.

As shown, notches 830 may extend from an interior of flared end portion 826 toward the exterior of flared end portion 826 in a V-shaped configuration, with the inside portion of each notch 830 being narrower than an outside portion of each notch 830. In one implementation, connector body 802 may include six notches 830, however any suitable number of notches 830 may be provided.

In addition, as shown in FIG. 8A, each of notches 830 may be angled with respect to the longitudinal axis of connector body 802, such that a rearwardmost portion of each notch 830 extends completely through an inside surface of flared end portion 826.

Exemplary slots 830 may have an outside width of approximately 0.065 to 0.075 inches, an inside width of approximately 0.025 to 0.035 inches (at in inside diameter of flared end portion 826), and an axial angle of approximately 15 to 35 degrees. Similar to notches 630 described above in FIGS. 6A and 6B, notches 830 may allow flared end portion 826 to collapse or compress in on itself in a uniform manner when sliding ring 204 is moved from the uncompressed position (shown in FIGS. 8A and 8B) to the compressed position (not shown).

Inner surface 814 of connector body 802 may include a first tubular portion 832, a second tubular portion 834, and a third tubular portion 836. Tubular portions 832-836 may be concentrically formed within connector body 802 such that post 108 may be received therein during assembly of connector 800. As shown in FIG. 8A, first tubular portion 832 may be formed at forward end 816 of connector body 802 and may have an inside diameter approximately equal to an outside diameter of a body engagement portion 138 of post 108. Second tubular portion 834 may have an inside diameter larger than the inside diameter of first tubular portion 832 and may form an annular notch 840 with respect to first tubular portion 832. Annular notch 840 may be configured to receive a body engagement barb 142 formed in post 108.

Third tubular portion 836 may have an inside diameter larger than the inside diameter of second tubular portion 834 and may form a cavity 844 for receiving a tubular extension 162 of post 108. Furthermore, as described below, post 108 may include a tubular cavity 148 therein. During connection of connector 800 to a coaxial cable, tubular cavity 148 may receive a center conductor and dielectric covering of the inserted coaxial cable and forward cavity 844 may receive a jacket and shield of the inserted cable. In the manner described above, notches 830 may be formed in the surface of third tubular portion 836, such that at least a portion of each notch 830 extends through the surface of third tubular portion 836.

Sliding ring 204 in FIGS. 8A and 8B may be substantially similar to sliding ring 204 described above with respect to FIGS. 2A-2C. That is, sliding ring 204 may include tubular body having rearward end 250, an inner annular protrusion 252, and forward end 254. As shown in FIG. 8A, sliding ring 204 may have an inside diameter approximately equal to an outside diameter of third cylindrical portion 824 Inner annular protrusion 252 may project from the inside of sliding ring 204 and may have an inside diameter approximately equal to an outside diameter of first annular groove 828, such that undesired rearward movement of sliding ring 204 relative to connector body 802 is minimized or limited.

As described above, post 108 may be configured for receipt within body 802 during assembly of connector 800 and may include flanged base portion 156, body engagement portion 138 having a body engagement barb 142, and tubular extension 162 projecting rearwardly from body engagement portion 138. Flanged base portion 156, body engagement portion 138 and tubular extension 162 together define inner chamber 148 for receiving a center conductor and insulator of an inserted coaxial cable. As shown in FIG. 8A, in one implementation, the rearward end of tubular extension 162 may include barb 164 to enhance compression of the outer jacket of the coaxial cable and to secure the cable within connector 800.

Tubular extension 162 of post 108, and third tubular portion 836 of connector body 802 together define annular cavity 844 for accommodating the jacket and shield of an inserted coaxial cable. In exemplary implementations, the distance between the outside diameter of tubular extension 162 and the diameter of third tubular portion 836 is between about 0.0585 to 0.0665 inches. This may also be referred to as the installation opening of connector 800. In one implementation, as shown in FIG. 8A, following assembly of post 108 into connector body 802, a rearward end of tubular extension 162 may be substantially even or flush with respect to an end of cable receiving end 818 of connector body 802.

Similar to annular nut 106 described above in relation to FIGS. 1A-1D and FIGS. 2A-2C, annular nut 106 in FIGS. 8A and 88 may be rotatably coupled to forward end 816 of connector body 802. Annular nut 106 may include any number of attaching mechanisms, such as that of a hex nut, a knurled nut, a wing nut, or any other known attaching means, and may be rotatably coupled to connector body 802 for providing mechanical attachment of connector 800 to an external device, e.g., port connector 180, via a threaded relationship.

Connector 800 may be supplied in an assembled condition, as shown in FIG. 8A, in which sliding ring 204 is installed on connector body 802 in a forward (e.g., uncompressed) position. A prepared end of a coaxial cable may be received through cable receiving end 818 of body 802 to engage post 108 of connector 800, as described above. Once the prepared end of the coaxial cable is inserted into connector body 802 so that the cable jacket is separated from the insulator by the sharp edge of post 108, sliding ring 204 may be moved axially rearward in direction A from the first position (shown in FIG. 8A) to a second position (not shown). In some embodiments, a compression tool may be used to advance sliding ring 204 from the first position to the second position.

As sliding ring 204 moves axially rearward in direction A, curved rearward end 250 of sliding ring 204 may engage the outer surface of flared end portion 826, thereby forcing flared end portion 826 radially inward toward post 108. In the manner described above, notches 830 in the flared end portion 826 may facilitate the radial compression of flared end portion 826 by providing a number of collapsing regions on an outer surfaced of flared end portion 826.

Upon continued rearward movement of sliding ring 204, annular protrusion 252 in sliding ring 204 may engage second annular groove 849 in flared end 826 (i.e. combining to form a retainer) to maintain sliding ring 204 in the second (e.g., compressed) position. In other implementations, a friction relationship between flared end portion 826 and sliding ring 204 may be sufficient to maintain sliding ring 204 in the second position following securing of a coaxial cable to connector 800.

Figure 9A:
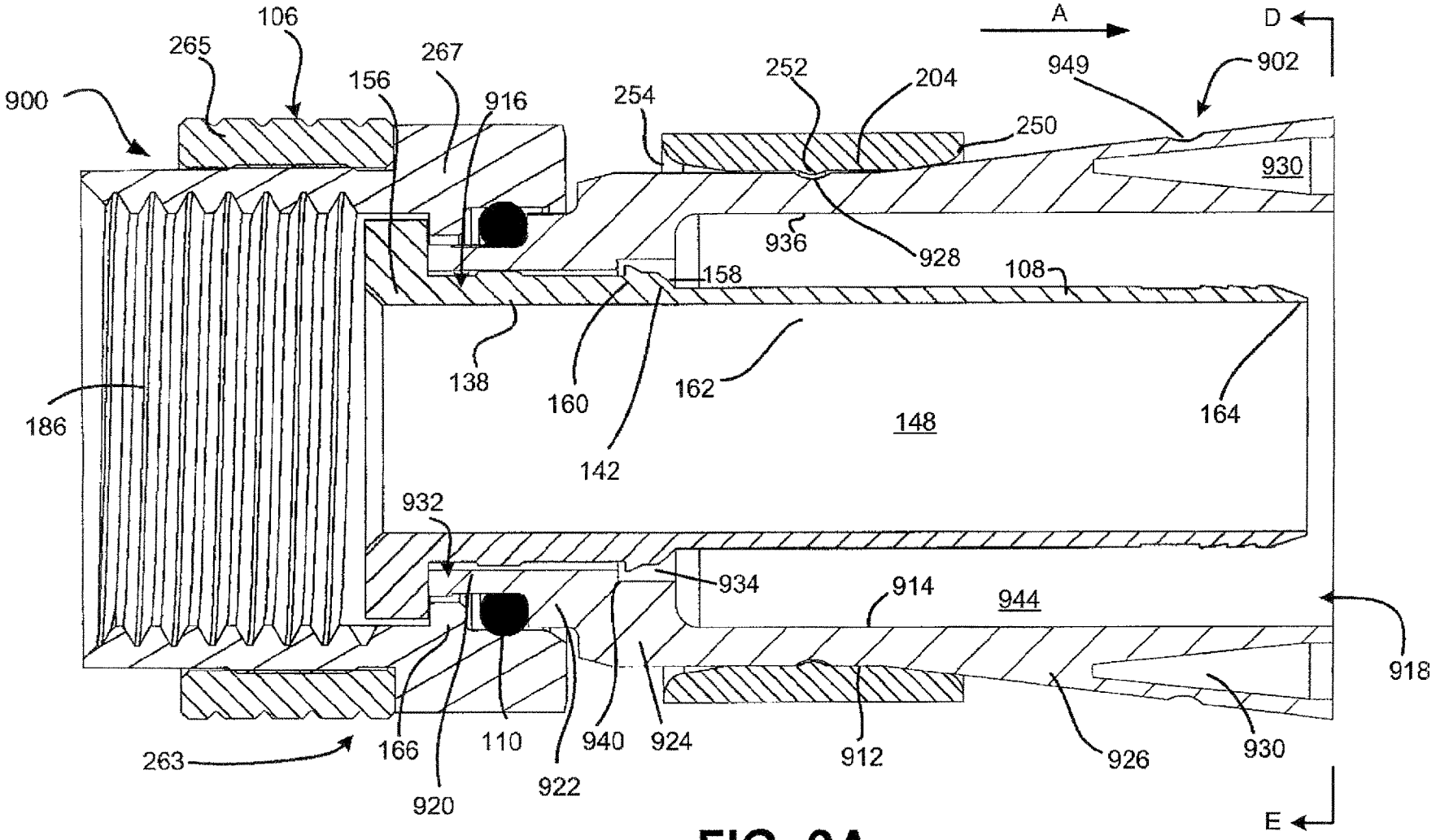
FIG. 9A is a cross-sectional view of yet another exemplary coaxial cable connector in an uncompressed configuration.
Figure 9B:
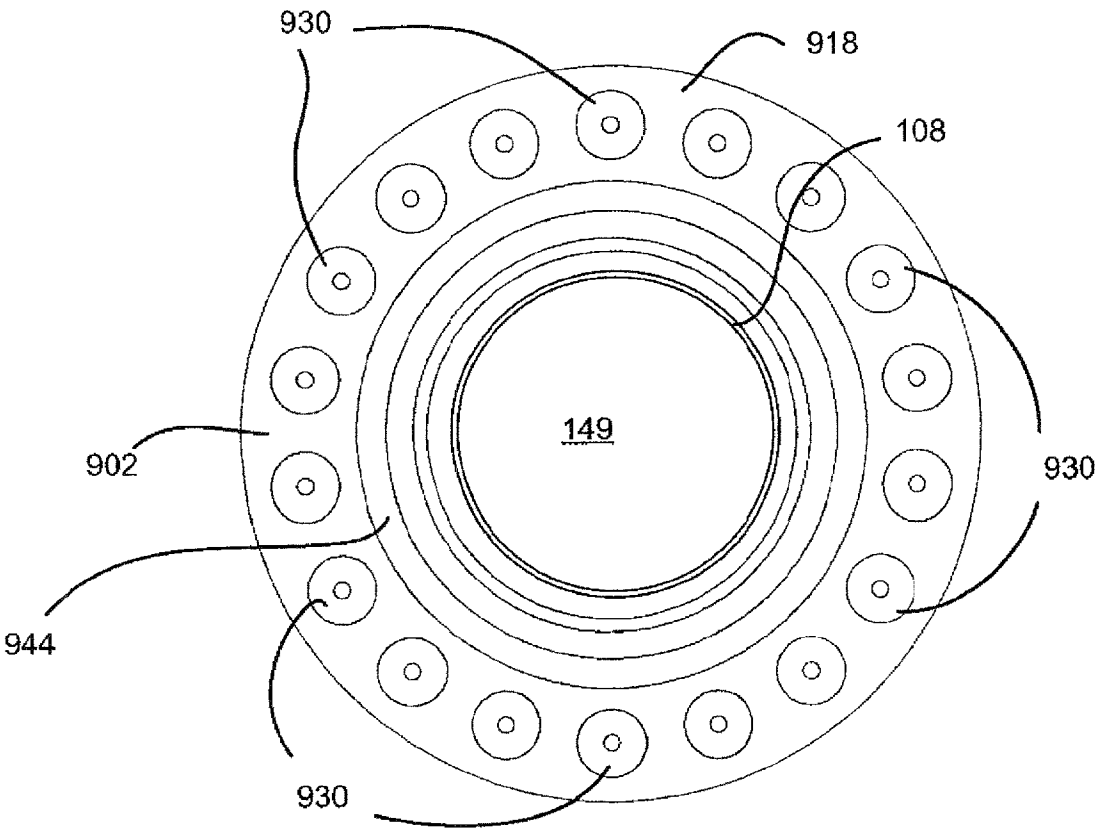
FIG. 9B is an end view of the coaxial cable connector of FIG. 9A taken along the line E-E in FIG. 9A.

Referring now to FIGS. 9A and 9B, yet another alternative implementation of a connector 900 is illustrated. The embodiment of FIGS. 9A and 9B is similar to the embodiments described above and similar reference numbers are used where appropriate. In the embodiment of FIGS. 9A and 9B, connector 900 may include connector body 902, sliding ring 204, nut 106, post 108, and O-ring 110.

Connector body 902, similar to connector body 602 of FIGS. 6A and 6B, may include an elongated, cylindrical member, formed of a resilient, compressible, or deformable material, such as a soft plastic or semi-rigid rubber material. Connector body 902 may include (1) outer surface 912, (2) inner surface 914, (3) forward end 916 coupled to annular post 108 and rotatable nut 106, and (4) cable receiving end 918, opposite forward end 916.

In one implementation, forward end 916 of connector body 902 may include a stepped configuration to receive a rearward end of nut 106 thereon. More specifically, as shown in FIG. 9A, forward end 916 of connector body 902 may include a first cylindrical portion 920, a second cylindrical portion 922 having a diameter larger than first cylindrical portion 920, a third cylindrical portion 924 having a diameter larger than second cylindrical portion 922, and a flared or ramped end portion 926 extending from third cylindrical portion 922 to cable receiving end 918 of connector body 902.

As shown, an initial outside diameter of flared end portion 926 may be substantially equal to the outside diameter of third cylindrical portion 922. In one embodiment, a peak outside diameter of flared end portion 926 (e.g., proximal to cable receiving end 918) may be approximately 0.09 inches larger than the outside diameter of third cylindrical portion 922. In other instances, the angle of flared end portion 926 may be approximately 6-10 degrees (e.g., 8 degrees) with respect to the longitudinal axis of connector 900.

As shown in FIG. 9A, third cylindrical portion 924 of body 902 may include a first annular groove 928. Annular groove 928 may mate with a corresponding annular protrusion 252 in sliding ring 204 to maintain sliding ring 204 in the first (e.g., non-compressed) position prior to compression of connector 900.

Flared end portion 926 of body 902 may include a second annular groove 949 formed in an intermediate exterior portion thereof. Second annular groove 949 may mate with corresponding annular protrusion 252 in sliding ring 204 to maintain sliding ring 204 in the second (e.g., compressed) position following compression of connector 900.

In addition, flared end portion 926 may include a plurality of axial holes 930 formed therein. Holes 930 may allow flared end portion 926 to compress in a uniform manner when sliding ring 204 is moved from the uncompressed position (shown in FIGS. 9A and 9B) to the compressed position (not shown).

In one exemplary embodiment, each of axial holes 930 may be substantially conical in shape with a larger diameter at an open end of each axial hole 930 (proximal to cable receiving end 918) and a smaller diameter at a closed end of each axial hole 930 (proximal to third cylindrical portion 924). In one implementation, the diameter of the open end of holes 930 is approximately 0.035 to 0.045 inches.

As shown in FIG. 9B, holes 930 may be formed in a radial spaced relationship about an end of flared end portion 926. In this manner, both the interior and exterior surfaces of flared end portion 926 may be uniform, without any holes or notches formed therein. In one implementation, connector body 902 may include eighteen holes 930, however any suitable number of holes 930 may be provided.

Inner surface 914 of connector body 902 may include a first tubular portion 932, a second tubular portion 934, and a third tubular portion 936. Tubular portions 932-936 may be concentrically formed within connector body 902 such that post 108 may be received therein during assembly of connector 900. As shown in FIG. 9A, first tubular portion 932 may be formed at forward end 916 of connector body 902 and may have an inside diameter approximately equal to an outside diameter of a body engagement portion 138 of post 108. Second tubular portion 934 may have an inside diameter larger than the inside diameter of first tubular portion 932 and may form an annular notch 940 with respect to first tubular portion 932. Annular notch 940 may be configured to receive a body engagement barb 142 formed in post 108.

Third tubular portion 936 may have an inside diameter larger than the inside diameter of second tubular portion 934 and may form a cavity 944 for receiving a tubular extension 162 of post 108. Furthermore, as described below, post 108 may include a tubular cavity 148 therein. During connection of connector 900 to a coaxial cable, tubular cavity 148 may receive a center conductor and dielectric covering of the inserted coaxial cable and forward cavity 944 may receive a jacket and shield of the inserted cable.

Sliding ring 204 in FIGS. 9A and 9B may be substantially similar to sliding ring 204 described above with respect to FIGS. 2A-2C. That is, sliding ring 204 may include tubular body having rearward end 250, an inner annular protrusion 252, and forward end 254. As shown in FIG. 9A, sliding ring 204 may have an inside diameter approximately equal to an outside diameter of third cylindrical portion 924 Inner annular protrusion 252 may project from the inside of sliding ring 204 and may have an inside diameter approximately equal to an outside diameter of first annular groove 928, such that undesired rearward movement of sliding ring 204 relative to connector body 902 is minimized or limited.

As described above, post 108 may be configured for receipt within body 902 during assembly of connector 900 and may include flanged base portion 156, body engagement portion 138 having a body engagement barb 142, and tubular extension 162 projecting rearwardly from body engagement portion 138. Flanged base portion 156, body engagement portion 138 and tubular extension 162 together define inner chamber 148 for receiving a center conductor and insulator of an inserted coaxial cable. As shown in FIG. 9A, in one implementation, the rearward end of tubular extension 162 may include barb 164 to enhance compression of the outer jacket of the coaxial cable and to secure the cable within connector 900.

Tubular extension 162 of post 108, and third tubular portion 936 of connector body 902 together define annular cavity 944 for accommodating the jacket and shield of an inserted coaxial cable. In exemplary implementations, the distance between the outside diameter of tubular extension 162 and the diameter of third tubular portion 936 is between about 0.0585 to 0.0665 inches. This may also be referred to as the installation opening of connector 900. Following assembly of post 108 into connector body 902, a rearward end of tubular extension 162 may be substantially even or flush with respect to an end of cable receiving end 918 of connector body 902.

Similar to annular nut 106 described above in relation to FIGS. 1A-1D and FIGS. 2A-2C, annular nut 106 in FIGS. 9A and 9B may be rotatably coupled to forward end 916 of connector body 902. Annular nut 106 may include any number of attaching mechanisms, such as that of a hex nut, a knurled nut, a wing nut, or any other known attaching means, and may be rotatably coupled to connector body 902 for providing mechanical attachment of connector 900 to an external device, e.g., port connector 180, via a threaded relationship.

Connector 900 may be supplied in an assembled condition, as shown in FIG. 9A, in which sliding ring 204 is installed on connector body 902 in a forward (e.g., uncompressed) position. A prepared end of a coaxial cable may be received through cable receiving end 918 of body 902 to engage post 108 of connector 900, as described above. Once the prepared end of the coaxial cable is inserted into connector body 902 so that the cable jacket is separated from the insulator by the sharp edge of post 108, sliding ring 204 may be moved axially rearward in direction A from the first position (shown in FIG. 9A) to a second position (not shown). In some embodiments, a compression tool may be used to advance sliding ring 204 from the first position to the second position.

As sliding ring 204 moves axially rearward in direction A, curved rearward end 250 of sliding ring 204 may engage the outer surface of flared end portion 926, thereby forcing flared end portion 926 radially inward toward post 108. In the manner described above, axial holes 930 in the flared end portion 926 may facilitate the radial compression of flared end portion 926 by providing a number of collapsing regions within flared end portion 926.

Upon continued rearward movement of sliding ring 204, annular protrusion 252 in sliding ring 204 may engage second annular groove 949 in flared end 926 (i.e., combining to form a retainer) to maintain sliding ring 204 in the second (e.g., compressed) position. In other implementations, a friction relationship between flared end portion 926 and sliding ring 204 may be sufficient to maintain sliding ring 204 in the second position following securing of a coaxial cable to connector 900.

The foregoing description of exemplary embodiments provides illustration and description, but is not intended to be exhaustive or to limit the embodiments described herein to the precise form disclosed. Modifications and variations are possible in light of the above teachings or may be acquired from practice of the embodiments.

For example, various features have been mainly described above with respect to a coaxial cables and connectors for securing coaxial cables. In other embodiments, features described herein may be implemented in relation to other types of cable or interface technologies. For example, the coaxial cable connector described herein may be used or are usable with various types of coaxial cable, such as 50, 75, or 93 ohm coaxial cable, or other characteristic impedance cable designs.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

The following is claimed:

1. A coaxial cable connector comprising:

a connector body having a forward end and a rearward end, the rearward end being configured to receive a portion of a coaxial cable;

a coupler configured to be rotatably coupled to the forward end of the connector body; and a slider configured to receive the connector body, the slider being configured to move relative to the connector body in a rearward direction from a first position to a second position, wherein the slider is configured to compress a portion of the coaxial cable between the connector body and a post received by the connector body as a result of the slider being moved from the first position to the second position.

2. The coaxial cable connector of claim 1, wherein the connector body comprises an outer surface, the outer surface comprising at least one groove, the at least one groove defining a space.

3. The coaxial cable connector of claim 2, wherein the slider comprises an inner surface, the inner surface configured to at least partially occupy the space when the slider is moved to the second position.

4. The coaxial cable connector of claim 2, wherein the slider comprises an inner surface, the inner surface comprising a protrusion, the protrusion configured to fit within the space when the slider is moved to the second position.

5. The coaxial cable connector of claim 1, which comprises a retainer configured to maintain the slider in the second position.

6. The coaxial cable connector of claim 1, wherein the second position comprises a compressed position.

7. The coaxial cable connector of claim 1, wherein the connector body comprises an intermediate portion between the forward and rearward ends, the intermediate portion comprising a diameter that increases from a first location along an axis of the connector body to a second location along the axis, the second location being rearward of the first location.

8. The coaxial cable connector of claim 1, wherein the connector body is compressible.

9. The coaxial cable connector of claim 1, wherein the post comprises a flange.

10. The coaxial cable connector of claim 1, wherein the slider comprises a rearward inner surface.

11. The coaxial cable connector of claim 10, wherein the rearward inner surface is configured to engage the rearward end of the connector body after the slider is slid from the first position to the second position.

12. The coaxial cable connector of claim 11, wherein the rearward inner surface comprises one of: an angled surface, a curved surface and a beveled surface.

13. The coaxial cable connector of claim 1, wherein the portion of the coaxial cable comprises a cable jacket.

14. The coaxial cable connector of claim 1, wherein the rearward end of the connector body comprises a flared end portion.

15. The coaxial cable connector of claim 14, wherein the flared end portion comprises a plurality of notches.

16. The coaxial cable connector of claim 1, wherein the forward end comprises a forward end diameter, the rearward end comprising a rearward end diameter, the rearward end diameter being greater than the forward end diameter.

17. A connector configured to be assembled with a coaxial cable, comprising:

an inner tube configured to receive the coaxial cable;

a locknut having a rear portion sleeved around a front portion of said inner tube;

a cylindrical casing sleeved around said inner tube;

a ring sleeved around the cylindrical casing, wherein the ring is movable along the cylindrical casing in an axial direction away from the locknut.

18. The connector of claim 17, wherein the inner tube includes a barbed portion at a rear end of the inner tube, wherein the barbed portion is configured to contact a braided conductor of the coaxial cable and surround an insulation spacer of the coaxial cable that surrounds a center conductor of the coaxial cable.

19. A connector configured to be assembled with a coaxial cable, comprising:

an inner tube configured to receive the coaxial cable;

a locknut sleeved around a portion of the inner tube;

a cylindrical casing sleeved around the inner tube; and a compressing element sleeved around the cylindrical casing, wherein the cylindrical casing is configured to be inwardly deformable by moving the compressing element away from the locknut in an axial direction of the connector.

20. The connector of claim 19, wherein the inner tube includes a barbed portion at a rear end of the inner tube, wherein the barbed portion is configured to contact a braided conductor of the coaxial cable and surround an insulation spacer of the coaxial cable that surrounds a center conductor of the coaxial cable.

* * * * *